United States Patent [19]

Capps et al.

[11] Patent Number: 5,074,182

[45] Date of Patent: Dec. 24, 1991

[54] MULTIPLE KEY ELECTRONIC INSTRUMENT HAVING BACKGROUND SONGS EACH ASSOCIATED WITH SOLO PARTS WHICH ARE SYNCHRONIZED WITH AND HARMONIOUS WITH THE BACKGROUND SONG

[75] Inventors: Stephen P. Capps, Sunnyvale; Raymond H. DuFlon, Woodside; Edgar N. Bogas, San Francisco, all of Calif.

[73] Assignee: Noise Toys, Inc., Woodside, Calif.

[21] Appl. No.: 469,095

[22] Filed: Jan. 23, 1990

[51] Int. Cl.[5] ..... G10M 7/00

[52] U.S. Cl. ..... 84/609; 84/600

[58] Field of Search ..... 84/609, 610, 611, 612, 84/634, 635, 636, 645, 646, DIG. 30

[56] References Cited

U.S. PATENT DOCUMENTS 4,771,671 9/1988 Hoff, Jr. ..... 84/645

4,794,838 1/1989 Corrigan ..... 84/600

OTHER PUBLICATIONS

Casio Digital Guitar DG-1, Player's Manual, 12 pages, date unknown.

Fisher-Price Electronic Guitar, Instructions and Songs, pp. 1-16, dated 1988.

MIDI of Musicians by Craig Anderton, Amsco Publications, New York, pp. 1, 6-16, 51, 52, and 59-67, dated 1986.

Jam Session, by Bogas Productions, 1987.

*Primary Examiner*—William M. Shoop, Jr.

*Assistant Examiner*—Helen Kim

*Attorney, Agent, or Firm*—Blakely, Sokoloff, Taylor & Zafman

[57] ABSTRACT

An electronic instrument and method includes manual control switches for producing and controlling creative variations on pre-recorded song selections that remain synchronized and melodiously oriented to the selected song substantially independent of the timing of manual operation of control switches. Several instruments of similar design can be connected together to facilitate 'playing in a band' of such instruments which synchronize on the song selected via one instrument and which respond to individual solos or riffs 'played' on one instrument with corresponding, timed solo or riff capabilities on other instruments.

24 Claims, 26 Drawing Sheets

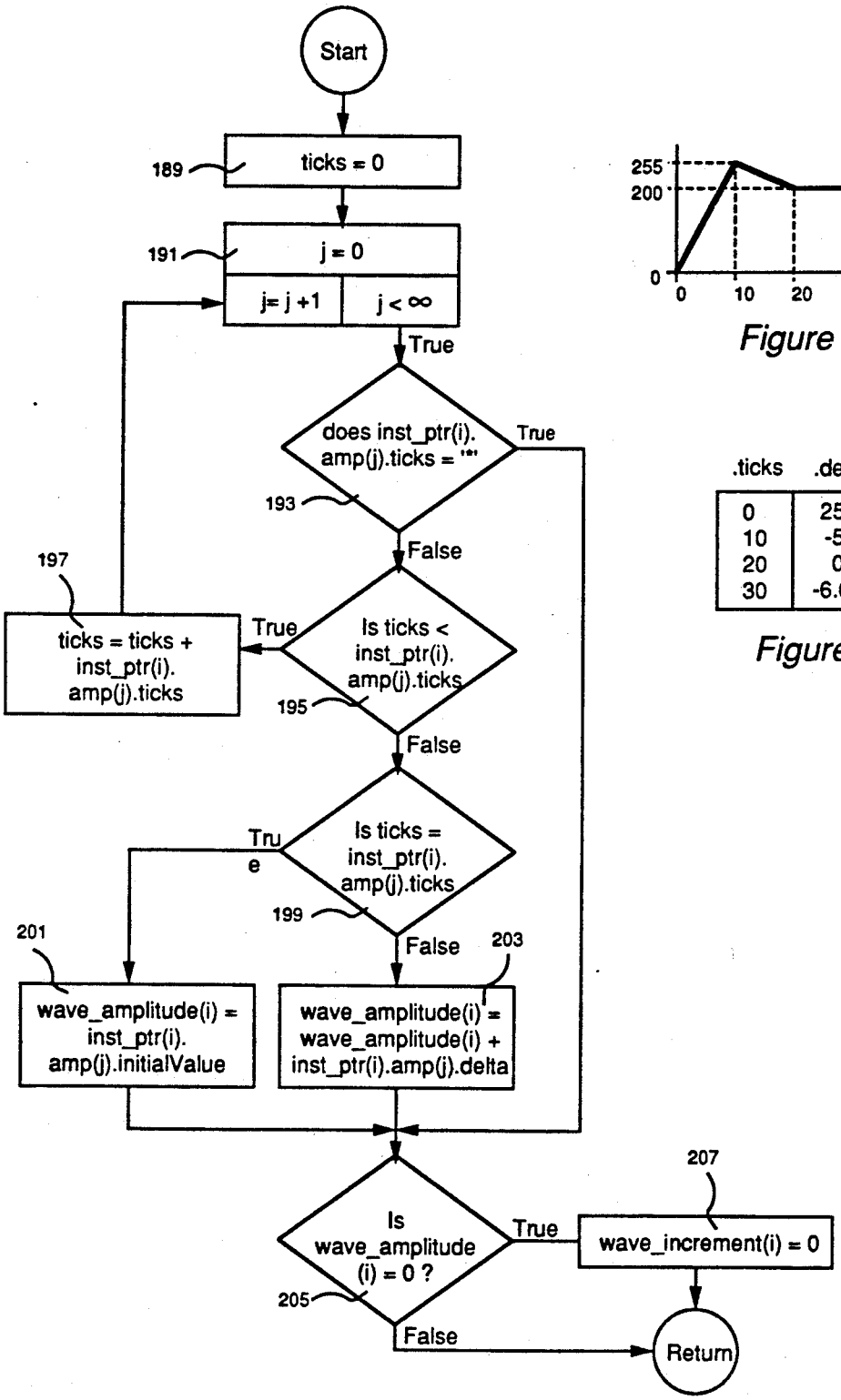
Figure 5(a)
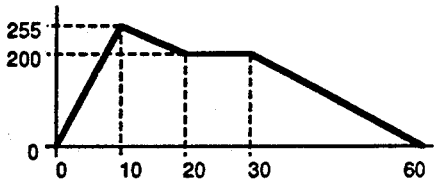
Figure 5(b)
| .ticks | .delta | initial value |
|---|---|---|
| 0 | 25.5 | 0 |
| 10 | -5.5 | 255 |
| 20 | 0.0 | 200 |
| 30 | -6.66 | 200 |
Figure 5(c)

Delta_Lookup

| | | | | | | | | | | | |
|---|---|---|---|---|---|---|---|---|---|---|---|
| $0400 | $043D | $047D | $04C2 | $050A | $0557 | $05A8 | $05FE | $0659 | $06BA | $0721 | $078D |
| $0800 | $087A | $08FB | $0983 | $0A14 | $0AAE | $0B50 | $0BFC | $0CB3 | $0D74 | $0E41 | $0F1A |
| $1000 | $10F4 | $11F6 | $1307 | $1429 | $155B | $16A1 | $17F9 | $1966 | $1AE9 | $1C82 | $1E34 |
| $2000 | $21E7 | $23EB | $260E | $2851 | $2AB7 | $2D41 | $2FF2 | $32CC | $35D1 | $3904 | $3CD1 |
| $4000 | $43CE | $47D6 | $4C1C | $50A3 | $556E | $5A82 | $5FE4 | $6598 | $6BA2 | $7209 | $78D1 |

Origin

*Figure 14(a)*

Bent_Lookup

| | | | | | | | | | | | |
|---|---|---|---|---|---|---|---|---|---|---|---|
| $0011 | $0013 | $0011 | $0013 | $0014 | $0015 | $0016 | $0017 | $0019 | $001A | $001C | $001E |
| $001F | $0021 | $0023 | $0025 | $0028 | $002A | $002D | $002F | $0032 | $0035 | $0038 | $003C |
| $003F | $0043 | $0047 | $004B | $0050 | $0055 | $005A | $005F | $0065 | $006B | $0071 | $0078 |
| $007F | $0087 | $008F | $0097 | $00A0 | $00AA | $00B4 | $00BF | $00CA | $00D6 | $00E3 | $00F1 |
| $00FF | $010E | $011E | $012F | $0141 | $0154 | $0169 | $017E | $0195 | $01AD | $01C7 | $01E2 |

Middle C

*Figure 14(b)*

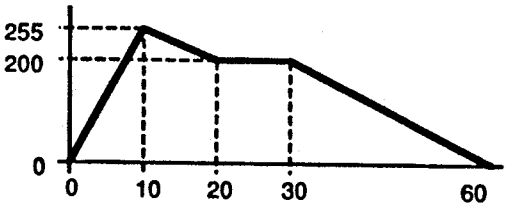
Figure 18(c)
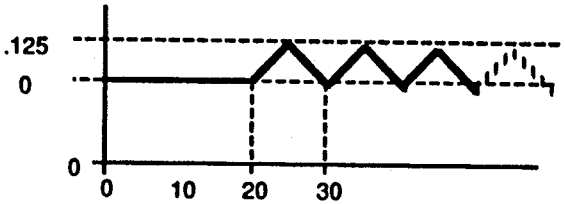
Figure 18(d)
| | | | | | |
|---|---|---|---|---|---|
| 790 | Loopback | -24 | | | |
| 792 | Bits | 200 | | | |
| 794 | Vibrato | 20 | 10 | .125 | -.125 |
| 796 | Amplitude 1 | 0 | 0 | 25.5 | |
| | Amplitude 2 | 10 | 255 | -5.5 | |
| | Amplitude 3 | 30 | 200 | 0 | |
| | Amplitude 4 | "" | 200 | -6.66 | |
Figure 18(b)
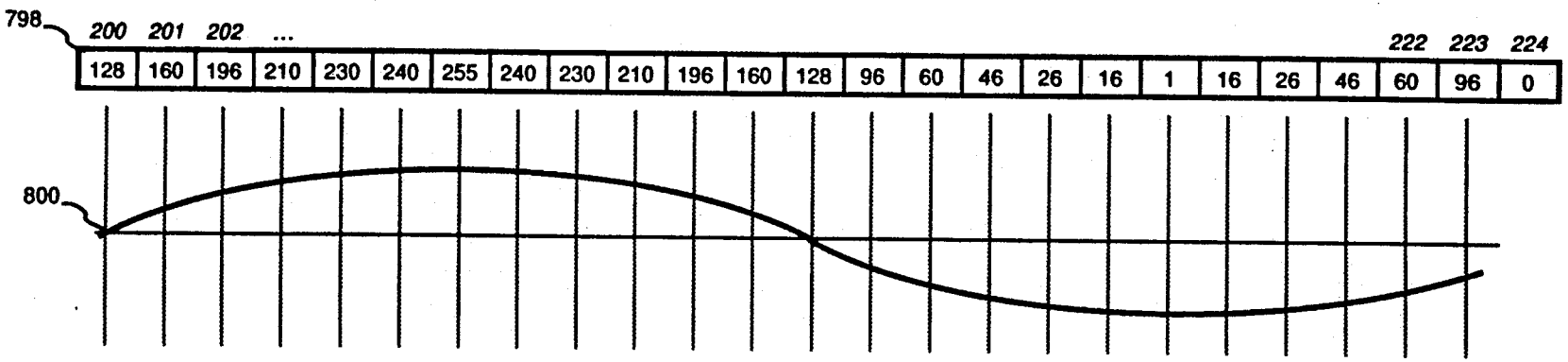
Figure18(e)

MULTIPLE KEY ELECTRONIC INSTRUMENT HAVING BACKGROUND SONGS EACH ASSOCIATED WITH SOLO PARTS WHICH ARE SYNCHRONIZED WITH AND HARMONIOUS WITH THE BACKGROUND SONG

BACKGROUND OF THE INVENTION

Field of Invention

This invention relates generally to electronic musical instruments, and more particularly to an electronic instrument that enables non-musicians to create and play enjoyable music.

Traditional instruments, electronic or not, require certain skills that must be developed. Usually, the player must practice to gain a fair amount of manual dexterity with any particular instrument before satisfying music can be produced: i.e., repeating scales on a piano, fingering chords on a guitar, correct bowing of a violin and the like. And, the player must also develop the ability to read music and translate the music into requisite action on the instrument. These two prerequisites prevent many a musician-to-be from developing the ability to make enjoyable music with an instrument.

A player who has acquired these skills can usually play solo parts. While solo piano can be quite pleasant, solo electric guitar, drums or bass may not be. In fact, if the player is a teenager, the genre of music is most likely rock and roll which requires at least three players on three different instruments. Beginners learning to play instruments such as these often play along with recordings. This is helpful at first, but, as the player becomes more skilled, the rigid structure imposed by the recording leaves little room for creative musical expression.

Many electronic instruments have been created to help alleviate these problems. Conventional touch chord organs play a predetermined chord at the press of single key on the keyboard. Also, some organs expand on the chord notion and include prerecorded segments of, for example, an entire "Big Band" playing that chord. Newer organs and synthesizers contain arpeggiators which play repeated patterns. If four keys are held down, the device quickly cycles between the four notes. While these types of innovations do simplify the required mechanical and musical skills, the player still must be familiar with music.

Recently, instruments have appeared (called "drum machines") which create percussive sounds and often are integrated into a keyboard instrument. These instruments permit the construction of rhythm patterns over which the player can add the lead parts from the keyboard. Also, bass machines have been added to contemporary keyboard instruments to generate bass patterns. The combination of these provide background rhythm tracks for the keyboard lead. Features of contemporary instruments do enhance the quality of the music thus created by providing more depth and diversity of sounds, but basic music skills are still required for the keyboard.

In recent years, instruments (and software for personal computers) have appeared that offer simplified music with which the player interacts. A few background tracks are played, perhaps simulating a rock and roll band. The operator can select and play a prerecorded segment "on top of" the back ground. The control over these segments is usually a simple key from the computer keyboard which doesn't provide the feel of a real instrument. Also, such instruments tend to have only a very limited repertoire of background tracks.

SUMMARY OF THE INVENTION

In accordance with the present invention, an electronic instrument plays selected background music as chosen and sequenced by the operator. The music contains instructions which specify numerous solo parts that the operator can also choose and play. The solo parts available are varied as the background music changes to ensure that the solo parts remain musical and pleasing. The controls to play solo parts are used to provide numerous combinations and to simulate the actions used to play a "real" instrument. A number of instruments can be electrically connected together to synchronize the background music and solo part selections to provide the pleasure of "playing in a band."

In one embodiment of the invention, a guitar-like instrument includes encoded musical material used to control an internal music synthesizer. This material includes a plurality of multi-part background songs and a plurality of solo parts (commonly referred to herein as "riffs") that harmonize with the background songs. Each background song includes a plurality of sections, for example, an introduction, a main part, a chorus, a refrain and a finale. Encoded in each background song are choices of which solo parts or riffs are available at any given time, along with program instructions on how to sequence the sections of the song, and each solo part includes encoded instructions on how to selectively modify notes in response to user stimuli. One embodiment of the invention includes a plurality of switches and controls including an array of switches called "fret switches" disposed along the neck that mimic the frets of a conventional guitar in size and distribution. There are also switches called string switches located on the body of the instrument that mimic guitar strings in size and distribution. In addition, there are switches (called sequencer switches) used to control the musical background songs, and there is a partially rotating control (called the "bender," as in a real guitar) which includes a lever resiliently mounted and an encoder coupled to an axle for digitizing the bender bar position in a conventional manner. Thus, pushing or pulling this bar or lever towards or away from the guitar body rotates the axle, and the encoder provides a plurality of distinct signals corresponding to the rotation that are used to modify the pitch of musical notes.

A specific song is chosen and activated by the sequencer switches. A solo or riff part is activated by pressing one or more of the string switches. The specific solo activated is selected by the combination of fret and string switches from the choices provided by the background song. If, during the playback of a solo part, the same string switch that activated the solo is pressed again, the solo part in progress from the previous playback is terminated. Also, once activated, the solo may repeat some notes indefinitely if the string switch is held down. If the string switch is released but the fret switch is held, selected notes of the solo may hold indefinitely. Additionally, if chosen by the solo part and activated by the user, the bender control may also raise or lower the pitch in predetermined increments. If all string switches are activated within a few milliseconds, a special solo, for example a chord, may be activated instead of the individual solos associated with each switch. This can be accomplished, for example, by strumming the string switches as if they were guitar strings. (In one embodiment, if a second fret switch is pressed to either side of the original one during the playing of the solo part, the pitch of the solo part may rise or fall in predetermined increments.) In one embodiment, the fret switches can be rocked back and forth to vary the pitch of the solo part slightly. The selection and activation of these modifications is encoded in both the background song and solo parts and can change over time.

Compatible instruments according to the present invention also can be connected together, and the choice and playback of background music is synchronized among these instruments. If the section playback is altered by one user, the others will follow. The music itself is synchronized so that the background song from each instrument plays the same notes for the same duration and at the same time. Any instrument may disconnect and will automatically resynchronize if later reconnected. The choice and modification of solo parts can also be shared and controlled by any instrument.

DESCRIPTION OF THE DRAWINGS

FIGS. 5(*c*) are flow charts, graph, and table, respectively, illustrating the steps for altering the envelope or amplitude of the waveform over time;

FIG. 14(*a*) is a look-up table representative of data relative to its recorded pitch for determining the pitch of played notes;

FIG. 14(*b*) is a look-up table representative of data relative to middle C for altering the pitch of played notes;

FIG. 17(*b*) is an illustration of a note opcode structure according to the present invention;

FIGS. 18(*c*)–(*e*) are graphs illustrating digitized values of envelope, vibrato, and note signal according to the present invention;

DESCRIPTION OF THE PREFERRED EMBODIMENT

Figure 1A:
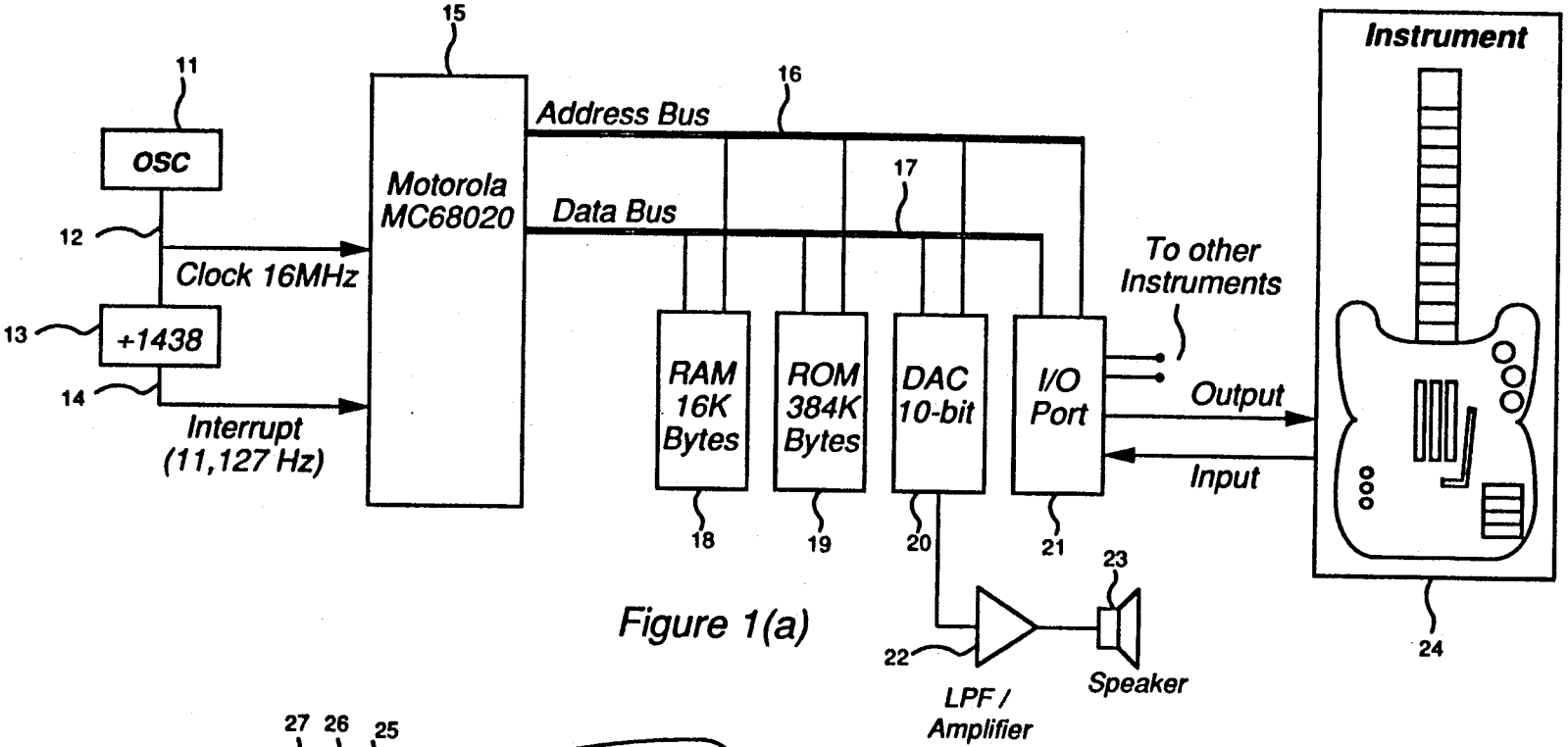
FIGS. 1(*a*) and (*b*) are block and pictorial diagrams, respectively, of a typical electronic instrument and associated electronic circuitry according to one embodiment of the present invention.
Figure 1B:
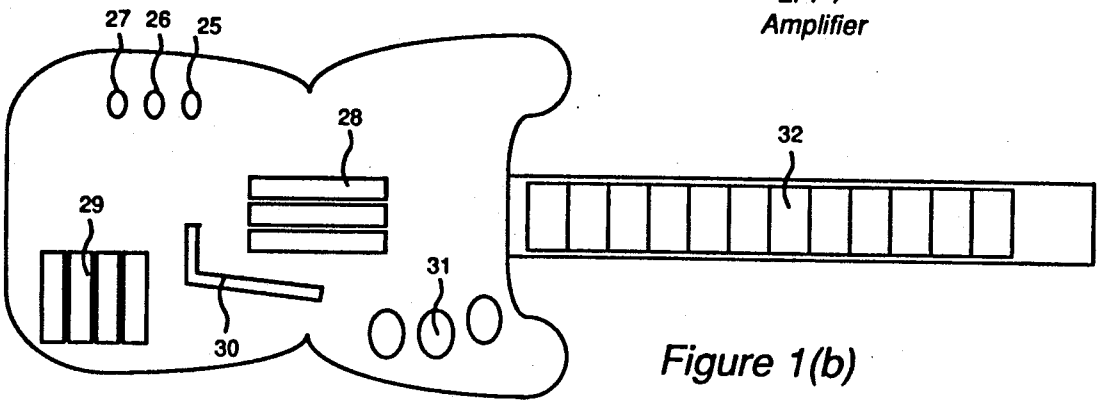

Referring now to FIG. 1(*a*), there is shown a block diagram of the entire system in accordance with one embodiment of the present invention. A central processor 15 such as Motorola 68020 is connected to data and address buses 16, 17 and is connected to receive system clock signals from oscillator 11, and is also connected to receive interrupt signals 14 (derived from oscillator 11 through divide-by-1438 divider 13). The interrupt signals 14 (at 11,127 Hz) are used to clock out digitized samples to the DAC 20 via the buses 16, 17. The output of the DAC 20 is filtered and amplified 22 in conventional manner to provide the audio signals that are delivered to the speaker 23. The Read Only Memory (ROM) 19 stores the programs, the digitized waveforms, and the musical song selections. The program plays the selected songs using those digitized waveforms as controlled by the operator via the instrument 24. A portion of the ROM 19 may be selectably connectable to a permanent portion of the ROM (or directly to the address and data buses) in order to facilitate convenient selection among numerous songs. The Random Access Memory (RAM) 18 provides storage needed for the operation of the processor. The Input-/Output (I/O) port 23 is connected to the processor 15 via the data and address buses 16, 17 and operates in a conventional manner to detect switch closures from the instrument 24. Other similar instruments may be connected together via their respective I/O ports 21 for band-like performance, as later described herein.

As illustrated in FIG. 1(*b*), the instrument 24 according to one embodiment of the present invention is shaped similarly to a guitar, but it should be understood that other embodiments may include instruments shaped similarly to a clarinet, saxophone, trumpet, or the like. The background song or music is selected by the song selection switch 25. When this switch is closed, the system plays a short theme representative of the selected song. The song is then started and its sections traversed in the manner later described herein in response to manual actuation of the start/next switch 26. When the operator desires to terminate the song, the finale switch 27 is pressed to schedule the finale, as later described herein.

A guitar riff is triggered by the closure of one or more of the three string switches 28. The particular riff thus played is determined by which, if any, of the twelve fret switches 32 are closed. Thus, thirteen different riffs per string switch are available. The pitch of particular notes in the riff can be altered by raising or lowering the bender bar 30, as later described. The fill riffs are obtained in response to manual closures of the keyboard switches 29 or the percussion pads 31, as later described herein.

Figure 2:
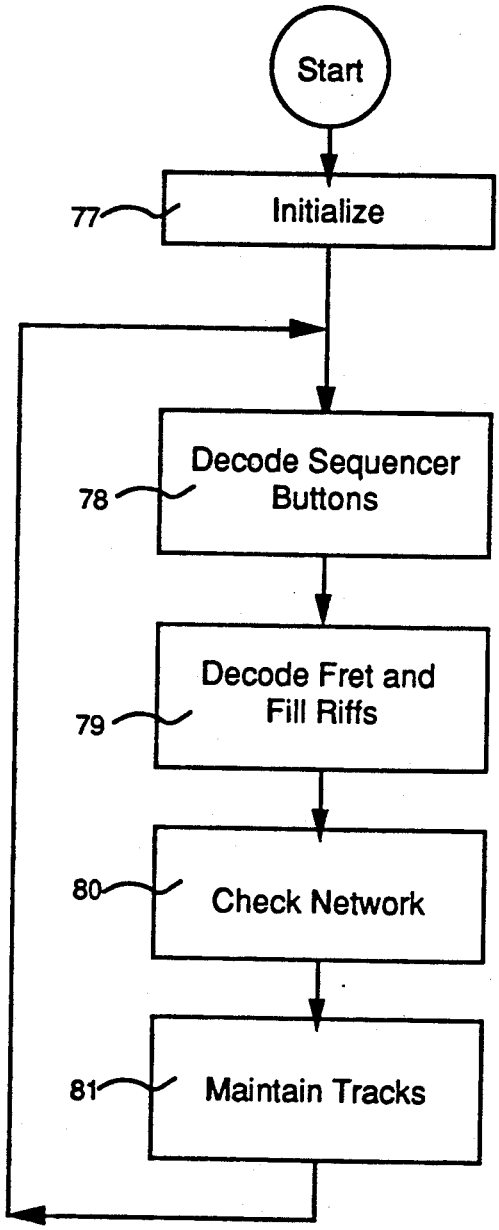
FIG. 2 is a flow chart illustrating the overall operating sequence according to the present invention subject to control by an operator.

Referring now to the overall flow chart of FIG. 2, the initialize step 77 in the overall routine of operation may be activated, for example, upon power-on or upon manual reset, and sets the start pressed and the finale_pressed and all old_strings states to false condition. Also, the next_song and all track_ptr are set to '*' (the notation '*' means the value is unassigned, that is, no section identification number has been set). Then, the operational condition of the sequencer switches 25, 26, 27 are decoded 78, and the operational conditions of the string and fret switches 28, 32 and fill switches 29, 31 are decoded 79. The network of other instruments, if any, is checked 80, and then each of several tracks is maintained 81 before the main routine loops or repeats again.

Figure 13:
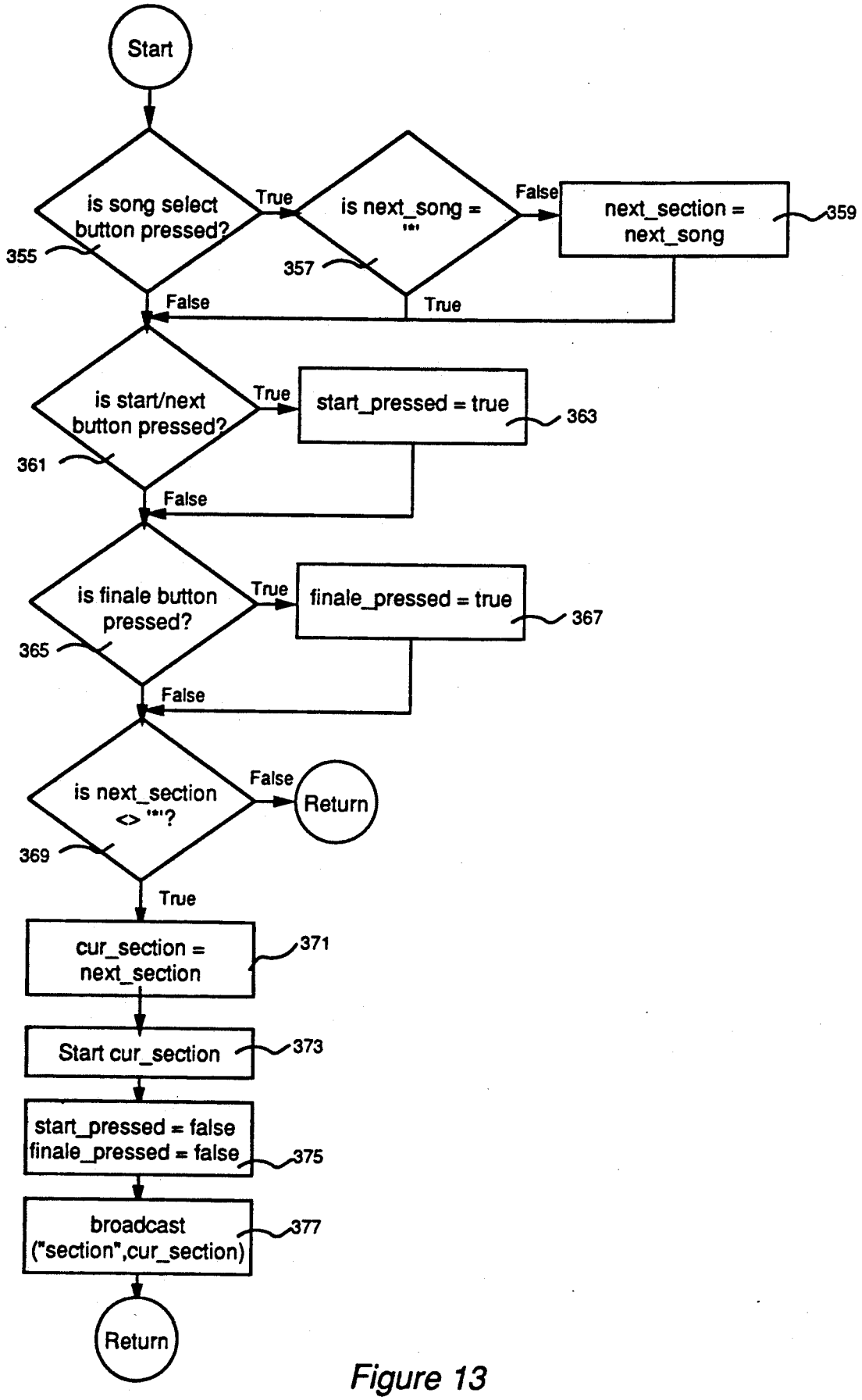
FIG. 13 is a flow chart illustrating the routine for decoding the sequencer buttons in the embodiment of FIG. 1.

As illustrated in the flow chart of FIG. 13, the routine 79 of FIG. 2 includes step 355 which determines if the song selection button or switch 25 is pressed and if so, then step 357 checks if next_song contains a valid section identification number. If a new section number has been posted 357 in the next_song, then the next_section 359 is set to that value which causes the section to be played in step 369. The next_section contains the identification number of the next section of a precomposed song to be played. The initial section to be played is number 0 and will be played at startup. The step 361 then determines if the start/next button or switch 26 is pressed, and if so, then the start_pressed is set 363 as true to indicate that the switch has been pressed. Step 365 then determines if the finale switch 27 is pressed, and if so, the finale_pressed flag is set true 367 to indicate that this switch has been pressed.

If an identification number has been assigned 369 in the next_section, that section should be played. Thus, cur_section is assigned 371 to this section to start playing it (which kills the existing background song tracks), as later described herein with reference to FIG. 8(*b*), step 243. Then, since a new section was started 373, any lingering transitions are cancelled by resetting start_pressed and finale_pressed 375 in case the operator pressed more than one transition button. The section notification and the new section identification number is broadcast 377 to any additional, connected instruments of similar design in order to have them also switch to the given section. Then, as illustrated in FIG. 2, other similar connected instruments are checked 80 to determine if they have broadcast any instructions, as described later herein with reference to FIG. 12. While playing the cur_section, each background track needs maintenance 81, as later described herein with reference to FIG. 3, and the main routine then loops or returns to step 78.

Figure 3:
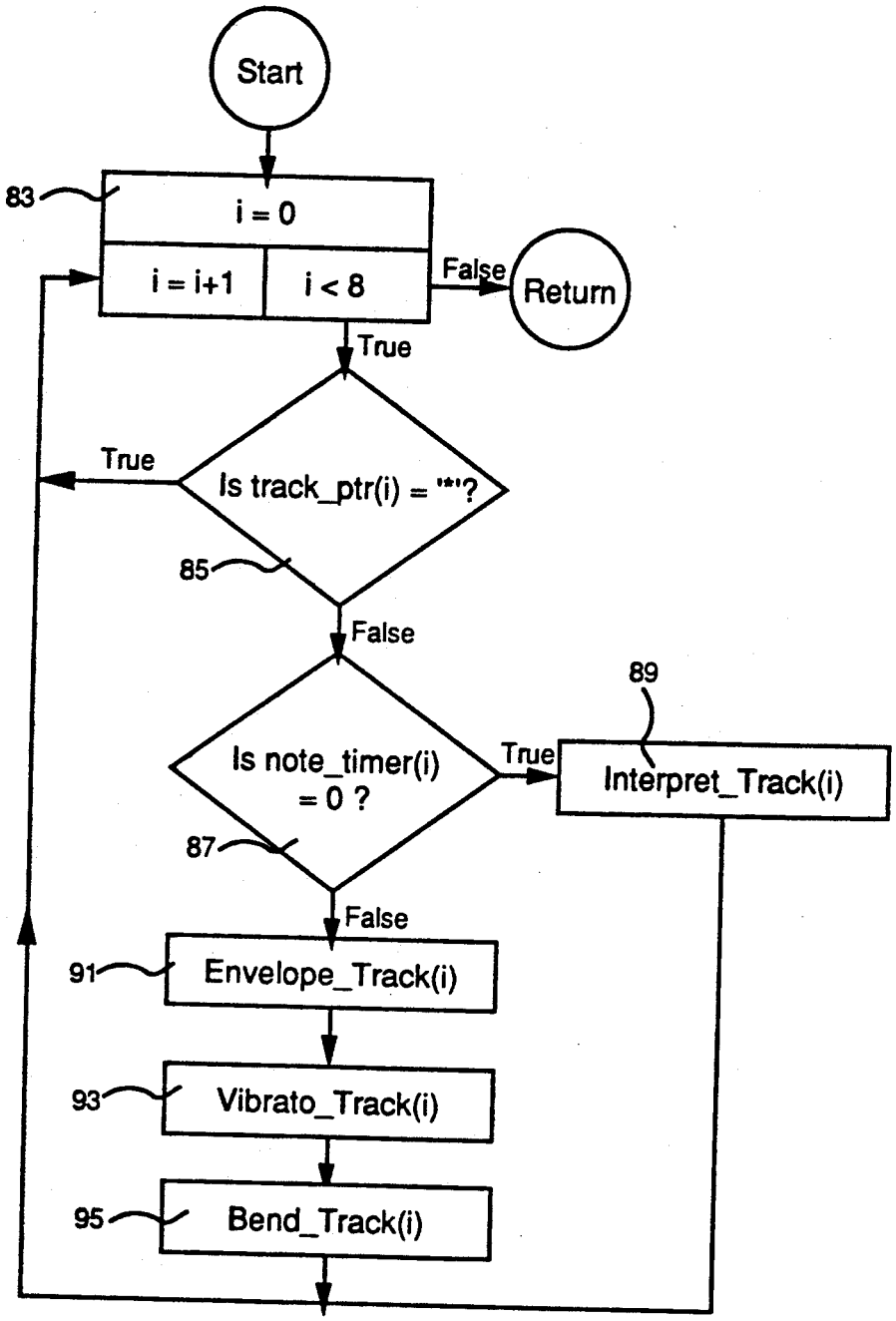
FIG. 3 is a flow chart illustrating the track maintenance routine.
Figure 4A:
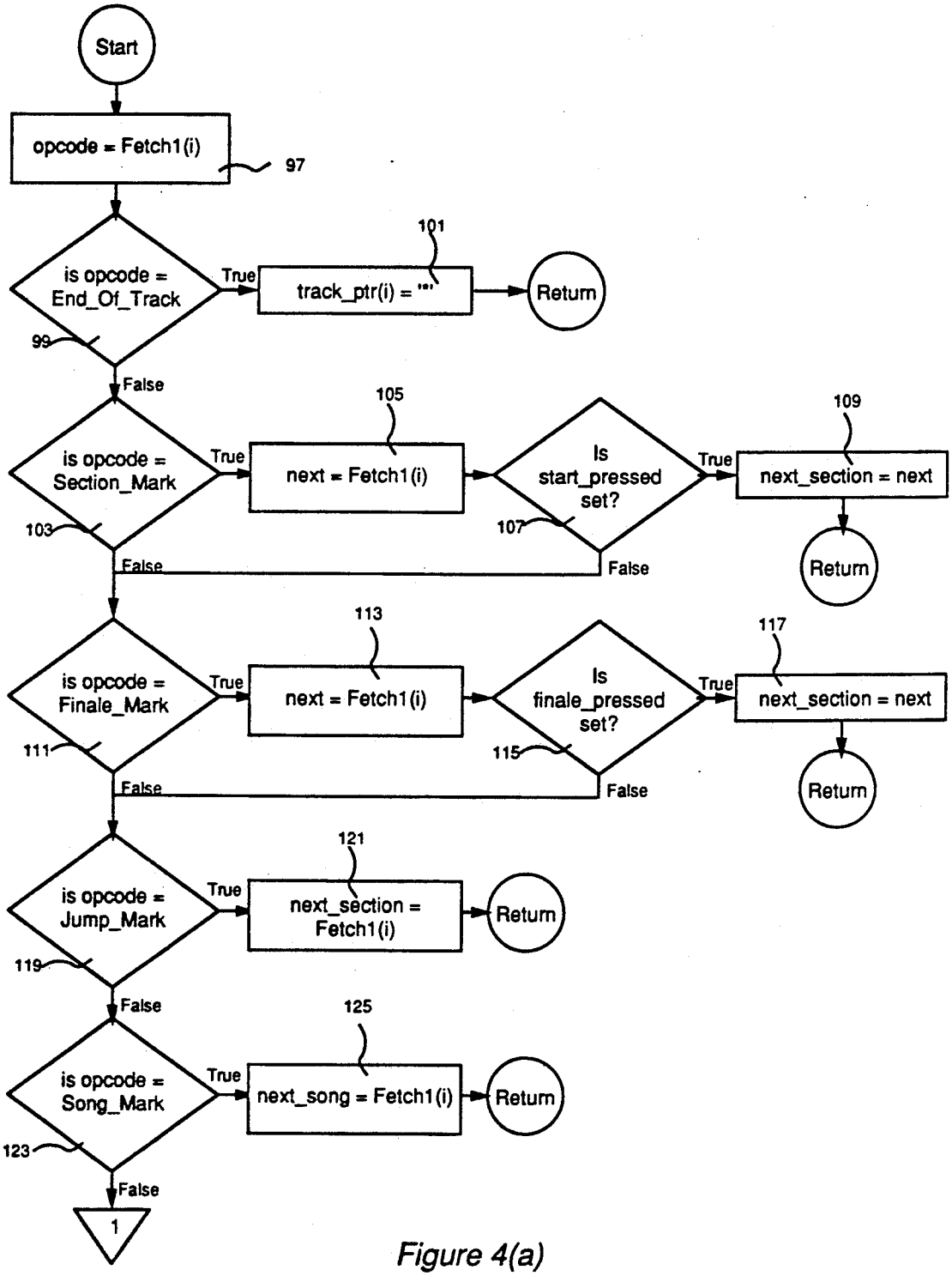
FIGS. 4 (*a*)–(*d*) are flow charts illustrating the steps for interpreting a given track of operating codes.
Figure 4B:
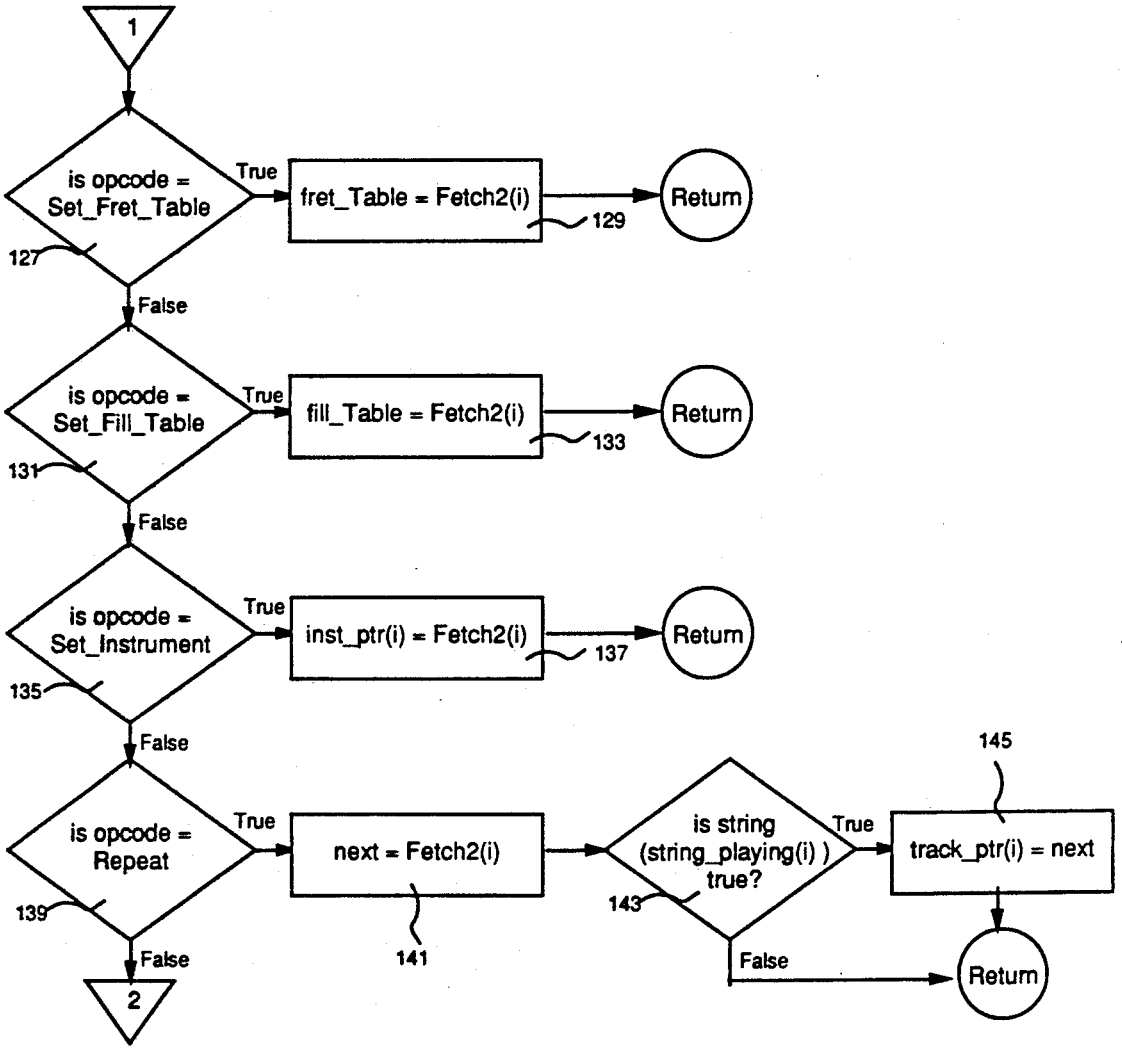
Figure 4C:
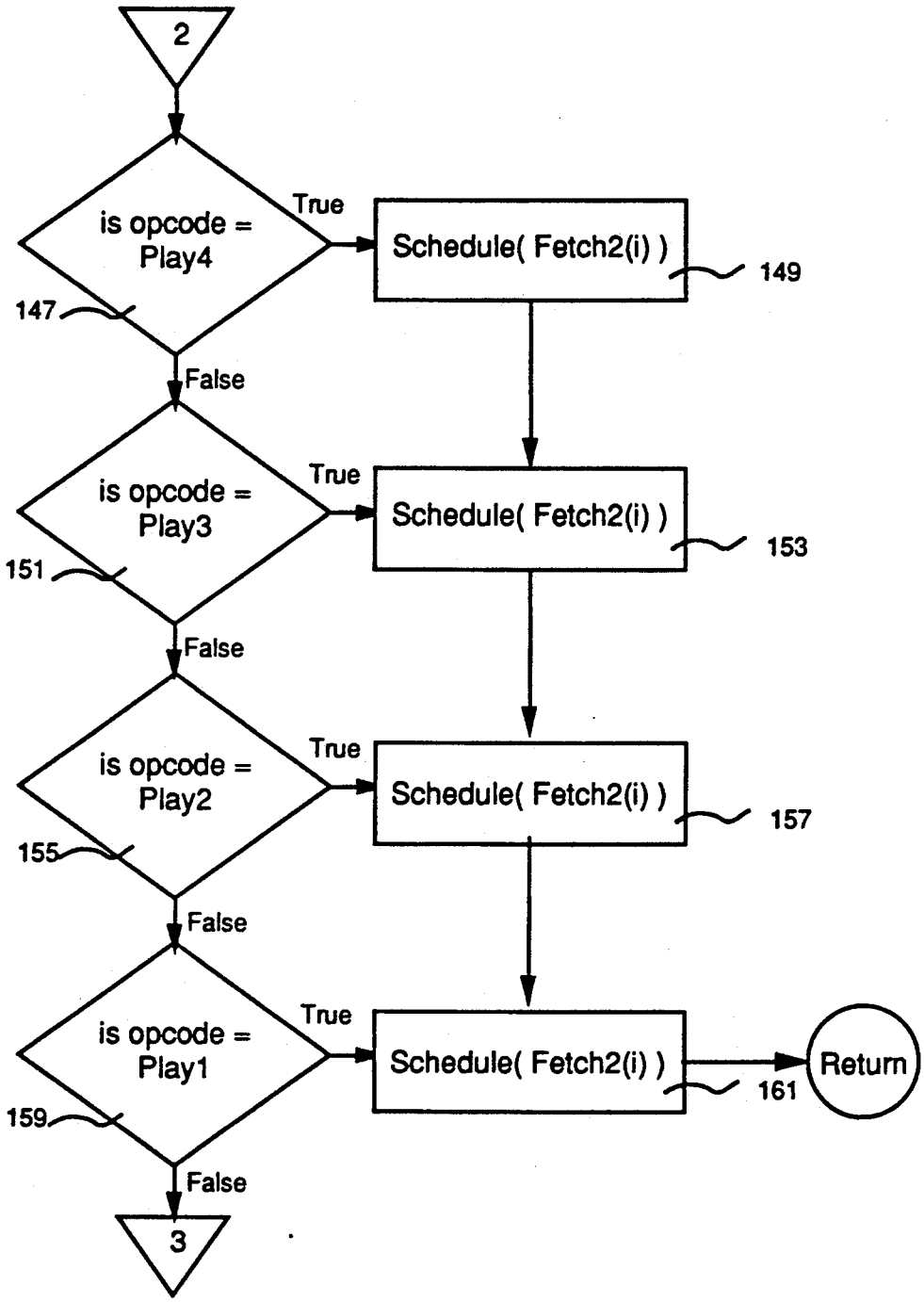
Figure 4D:
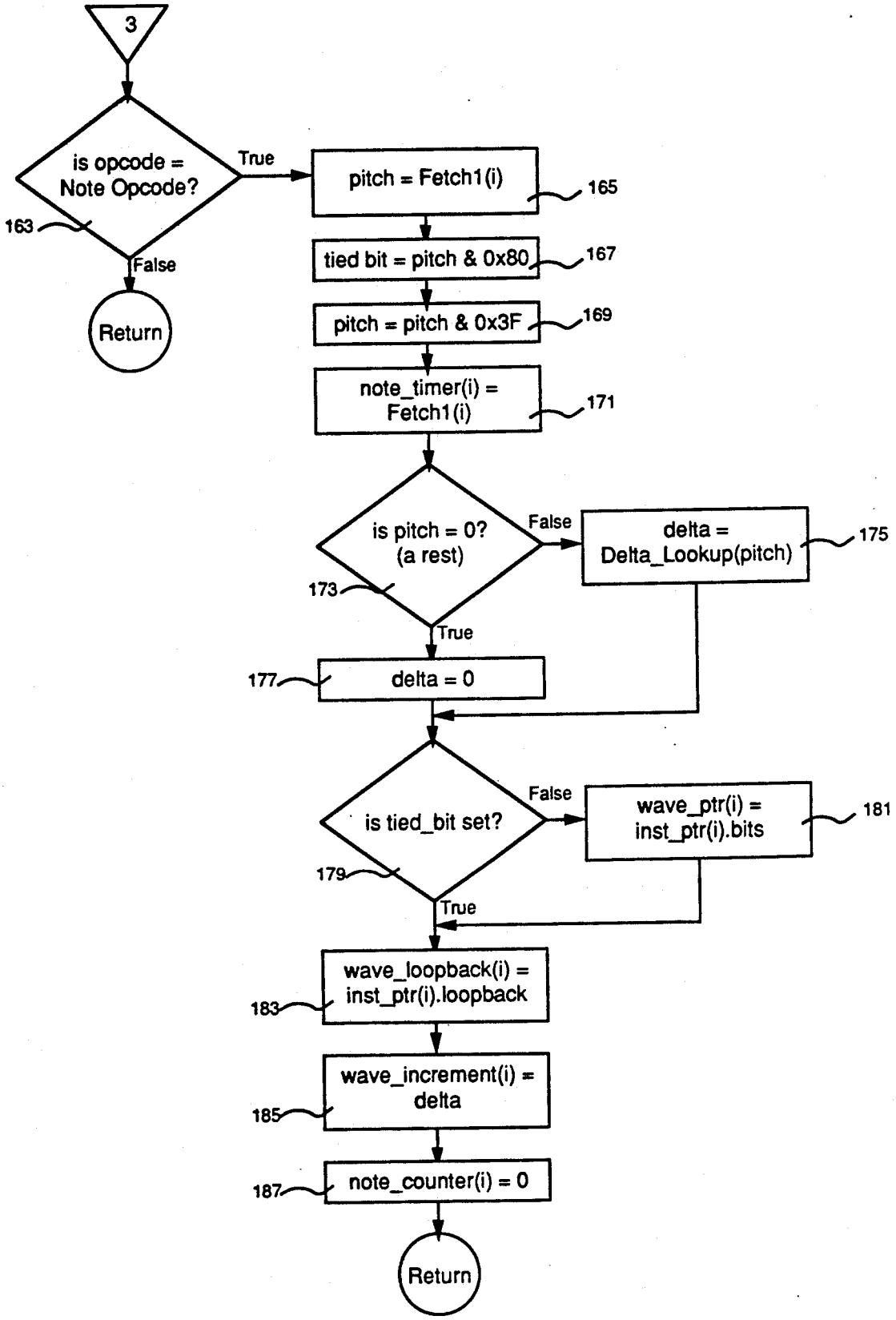

Referring now to the flow chart of FIG. 3, there is shown the track maintenance routine 81 of FIG. 2. The track maintenance routine begins and iterates through each track (for example, eight tracks) and services those that are active. Each track is driven by a pointer called track_ptr which points in memory to the operation codes, or opcodes for the track. These opcodes initiate musical notes, specify instruments, interact with the operator, and the like, as described herein with reference to FIG. 4. Specifically, the steps are iterated 83 for each of 8 tracks. If track_ptr is assigned a valid value 85, then it points to opcodes to be interpreted and is active. If not, the track is inactive and the body of the loop should be skipped. If the track is currently playing a note, it has a duration counter timing the note 87. For example, at 120 beats a minute, a quarter note, or one beat, has a duration of 0.5 seconds. Therefore, when a quarter note is started on a given track, that track's note_timer is set to 0.5 seconds and decremented over time. When the count reaches zero, the note is done and the next note should be started. So, if the note_timer is zero 87, then the track opcodes are interpreted 89, and if not zero, then the note currently playing is maintained. Step 89 interprets the opcode(s) at the current position of the track stored in track_ptr, as later described with reference to FIGS. 4(*e*)-(*d*).

Figure 6:
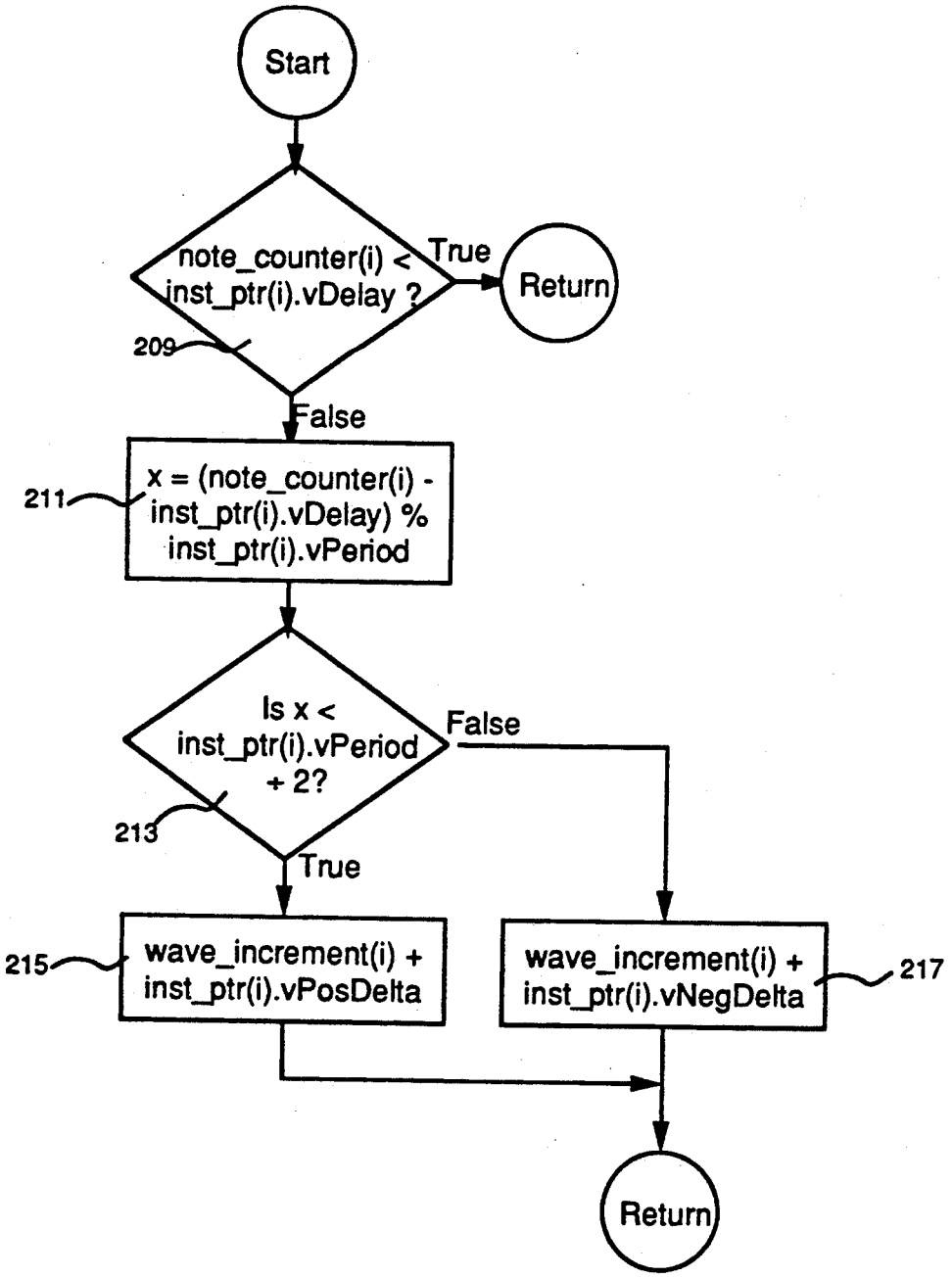
FIG. 6 is a flow chart illustrating a vibrato routine.
Figure 7:
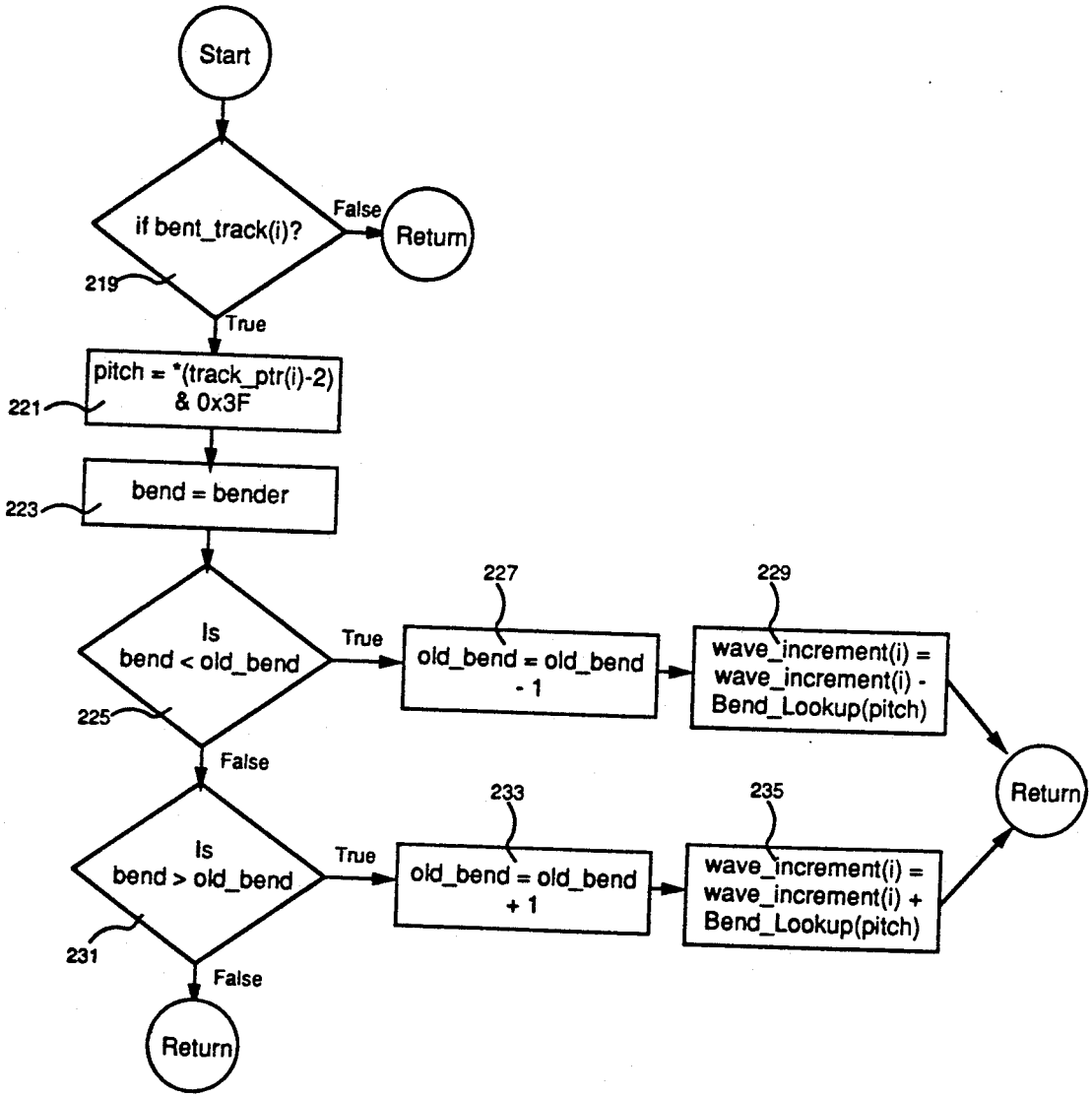
FIG. 7 is a flow chart illustrating a routine to simulate bender-bar control of the pitch of the instrument.

When a track is playing a particular note, its digitized form has an associated envelope or varying amplitude over time, as described herein with reference to FIG. (*a*)-(*c*). When a track is playing a particular note, its form may have an associated vibrato to be applied 93 as described herein with reference to FIG. 6. And, if the track is playing a note affected by the bender bar 95 (i.e. equivalent to manual tensioning of guitar strings), then the routine as described with reference to FIG. 7 is applied, as well. The routine for the maintenance of each track then begins again at step 83.

Referring now to the flow charts of FIG. 4(*a*)-(*d*), there is illustrated the routine for interpreting a given track in the routine of FIG. 3. The routine picks up the next opcode pointed to by track_ptr and operates on that code. Any particular opcode may fetch additional bytes. The effects of each opcode are explained in the appropriate step. Specifically, the next opcode is fetched at step 97 to see what it is. If the opcode is end-of-track 99, then the track is shut off to free up the track by setting track_ptr to the null value 101. The tracks are therefore dynamically allocated as needed. For example, every riff or solo ends with this opcode. If the opcode is a section mark 103 then an additional byte is fetched 105 which is the identification number of the next section. Then, if the start/next button 26 has been pressed (start_pressed is set true) 107, then next_section is set to this identification number 109 so that a new section can be started, as described in steps 69-77 of FIG. 1. Since these opcodes are embedded in a stream of opcodes for a song, the choice of the next_section is determined by the song.

If the opcode is a finale_mark 111, then an additional byte is fetched 113 which is the identification number of the finale section 115. Then, if the finale button 27 has been pressed (finale_pressed is set true), then next_section is set to this identification number 117 so that the finale section can be started as described in steps 365, 367 of FIG. 13. If the opcode is a jump_mark 119, then an additional byte is fetched 121 which is the identification number of a section. The next_section is set to this identification number so that the specified section can be immediately started, as described in steps 369-377 of FIG. 13. If the opcode is a song_mark 123, then an additional byte is fetched 125 which is the identification number of the first section of the next song. The next_song 125 is set to this identification in case the song selection button 25 is pressed, as described in steps 355-359 of FIG. 13.

Figure 17A:
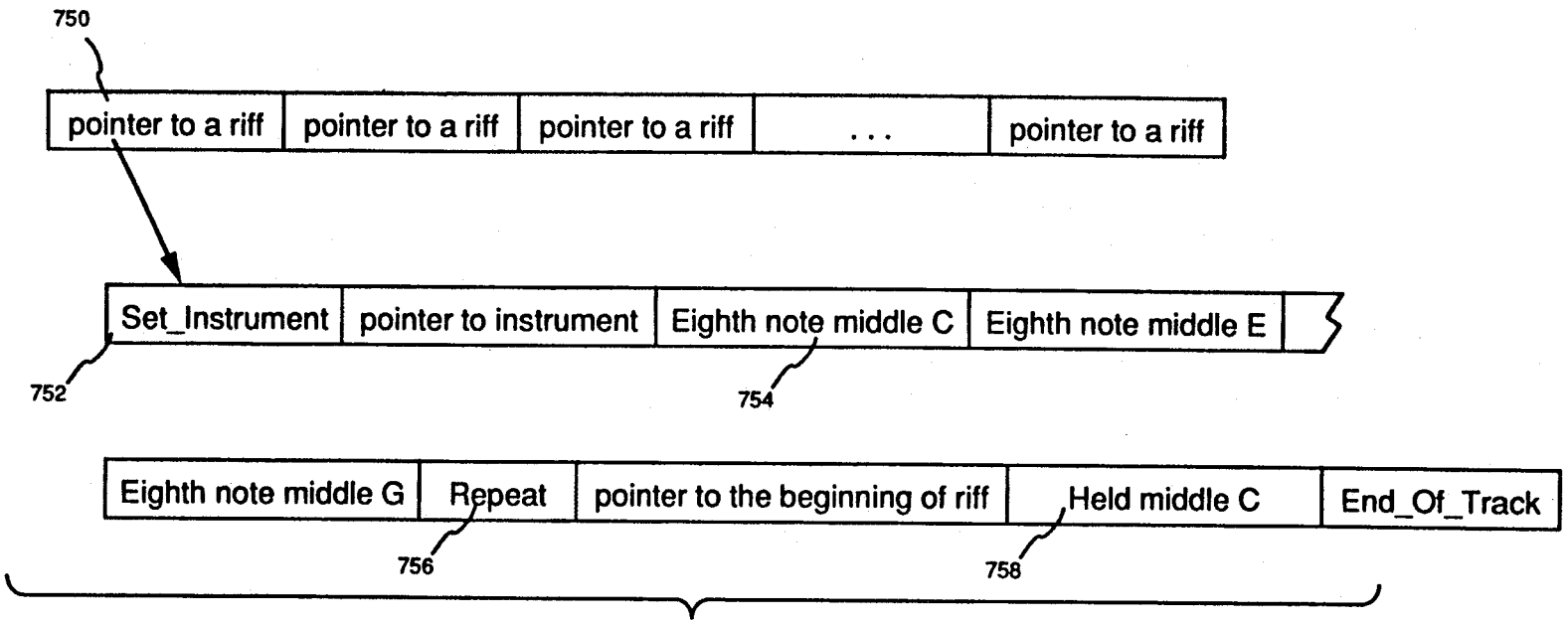
FIG. 17(*a*) is an illustration of the fret and fill table structures according to the present invention.
Figure 17B:
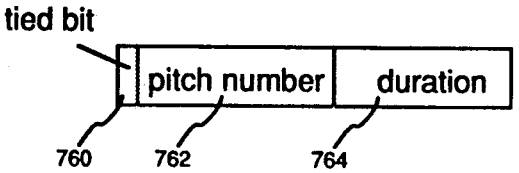

If the opcode is Set_Fret_Table 127, the next two bytes are fetched and stored in the pointer fret_table 129. This is used to specify which fret-controlled riffs should be played from now on. This table, as illustrated in FIG. 17, includes pointers to the opcodes for each fret-controlled riff. In one embodiment of the invention, as illustrated in FIGS. 1(*a*) and (*b*) there are three string buttons 28 plus a chord combination each having twelve fret buttons 32 which gives 52 entries in the fret table, as later described. The combination of a string button 28 with no fret button 32 pushed is valid. When the operator invokes a riff with a string button, or all three string buttons in the case of a chord, its corresponding entry is looked up in this table according to the fret button. The pointer obtained is then passed to the scheduling routine, later described herein with reference to FIG. 8(*a*), step 237. If the opcode is Set_Fill_Table 131, the next two bytes are fetched and stored in the pointer fill_table 133. This is used to specify which fill riffs should be played from now on. As with the fret table, the fill table of FIG. 17 includes pointers to the opcode for the fill riffs. In one embodiment of the invention, there are 7 fill buttons plus 6 chord combinations, as later described. When the operator invokes a riff with a fill button, or any two fill buttons, its corresponding entry is looked up in this table. The pointer obtained is then passed to the scheduling routine, later described herein with reference to FIG. 8(*a*), step 237. If the opcode is Set_Instrument 135, the next two bytes are fetched and stored in the pointer inst_ptr 137 which is unique for each track in that it points to the current instrument for this track and is used to modulate the track in amplitude (as illustrated in FIG. 5(*b*)) and vibrato (as illustrated in FIG. 6), and is also used when new notes are started as later described herein with reference to steps 163...187 of FIG. 4(*d*). If the opcode is a Repeat opcode 139, then the next two bytes which are a pointer to a previous location in opcode stream of this track are fetched 141. Then, if the string switch that caused this track to play is still down, the track_ptr 145 is set to the fetched pointer. The Boolean notation discussed herein reflects the hardware of the illustrated embodiment in that true means a string switch 28 is pressed and false means the string switch is not pressed. String_playing 143 is assigned the track number scheduled when a riff was started, as later described herein with reference to FIG. 10(*a*).

There are four opcodes 147, 151, 155, 159 which cause new tracks to be scheduled and assigned as illustrated in FIG. 4(*c*). In general, they are Play X, where X is the number of new tracks to play. Therefore, after the opcode there are X pointers to opcode streams 149, 153, 157, 161 to be played. Each of these pointers is scheduled, as later described herein with reference to FIG. 8(*a*), step 237, for assignment to one of the track_ptrs. If the fetched opcode is not a note code 163, as illustrated in FIG. 4(*d*), then the routine returns to the routine of FIG. 3. Otherwise a note opcode is two bytes, as follows:

(a) The first byte of a note opcode 165 is the pitch number (plus some tie/slur information), as illustrated in FIG. 17(*b*). Except for a pitch=zero, which means rest, this number is a relative pitch index for the note to be played. A "1" means play the note two octaves, or 24 half steps, below its recorded pitch, "2" means 23 half steps below, and so on up to "49" which means play the note two octaves above its recorded pitch. A "25" means play the note at its recorded pitch. For example, a piano playing a middle C is digitized and stored. If piano is the current instrument on this track and the pitch is 13, the note sounded will be one octave below middle C. Control of waveform on playback is described later herein with reference to FIG. 9. The high bit of the pitch is used to encode whether this note is musically tied or slurred 167 to the previous one. If so, the note should not be reattacked when this note is started, as described later herein with reference to step 181. This enables notes to be tied together if the pitch remains the same, or slurred if the pitch changes. Then, the high bits of the pitch are stripped off 169 since only 6 bits are needed to encode the pitch offset, as described above in step 165.

Figure 9:
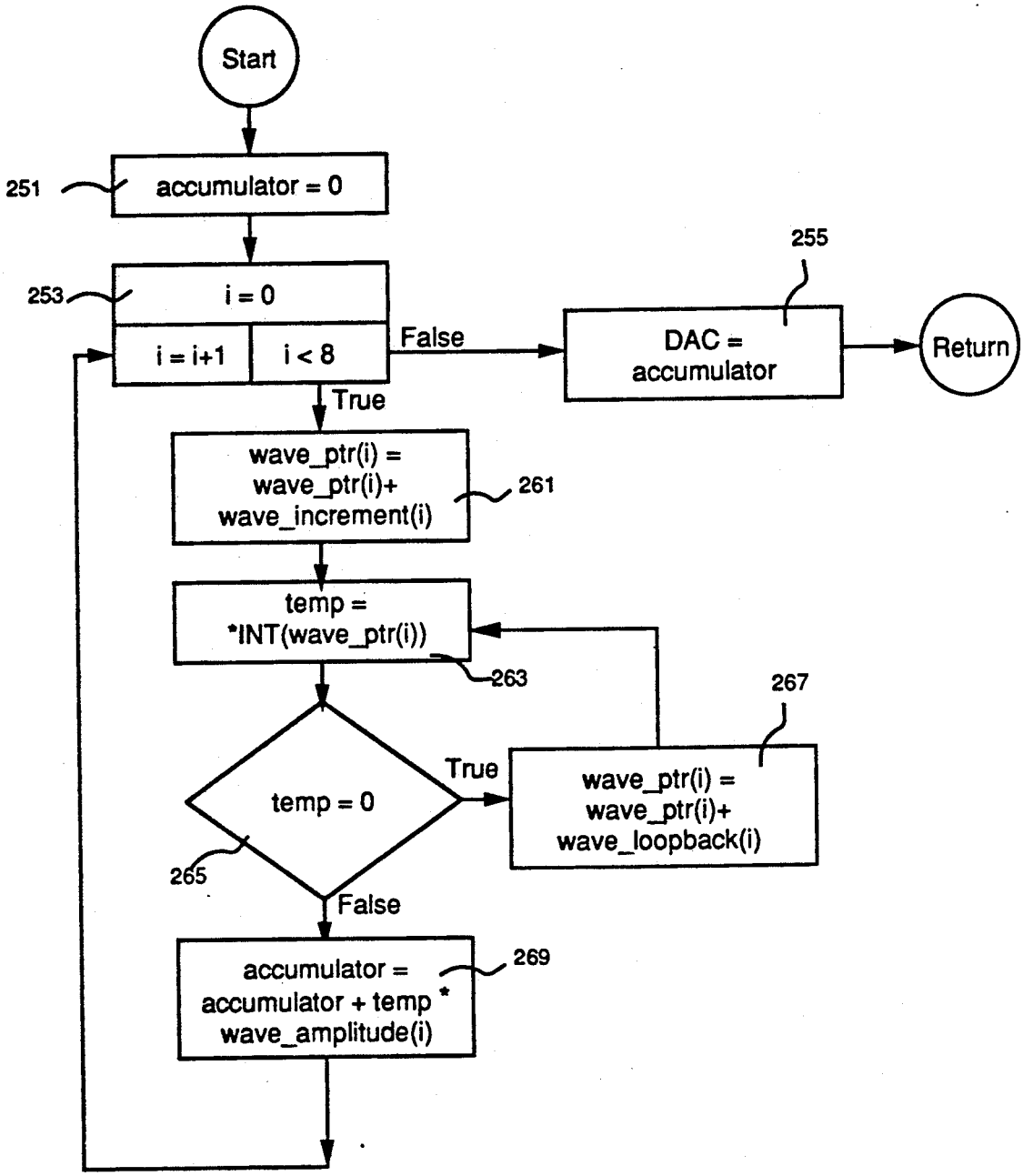
FIG. 9 is a flow chart illustrating the sound generation routine.

(b) The second byte of a note opcode 171 is the duration counter. This is counted down to zero to determine how long the note should be played, as previously described with reference to step 87 of FIG. 3. Using the pitch portion of the code, the playback delta is determined 173 from either the Delta_Lookup table, as illustrated in FIG. 14(*a*), or use of 0 if it is a rest. The lookup table contains 2-byte, fixed-point numbers (in hexadecimal notation) that determine how the digitized waveform is traversed, as later described herein with reference to FIG. 9. Unless the tied bit was set in the pitch opcode 179, the wave_ptr 181 of the track is set to the start of the current instrument's digitized waveform from a pointer is stored in inst_ptr(i).bits 181. The samples for this track will then be fetched from this location in memory, as illustrated in FIG. 9. If the tied bit was set, then the wave_ptr is not reset because the note should not be reattacked. By continuing a new note at the current location, the attack portion is skipped so this note and the previous one will be slurred together. The loopback delta, or wave_loopback, 183 for this track is set to the value stored in the current instrument (in inst_ptr(i).loopback), and this is used in FIG. 9 to loop the waveforms for sustained sounds, as later described herein. The wave_increment 185 for this track is set as determined from the pitch in steps 173–177. The increment is used in FIG. 9 to playback the waveforms at different sample rates to achieve different pitches from one sample, as later described herein. The note_counter for this track is then reset 187. This is used by the envelope and vibrato codes to measure how long the track has been playing this note since envelope and vibrato vary over time, as later described herein with reference to FIGS. 5 and 6.

Figure 18A:
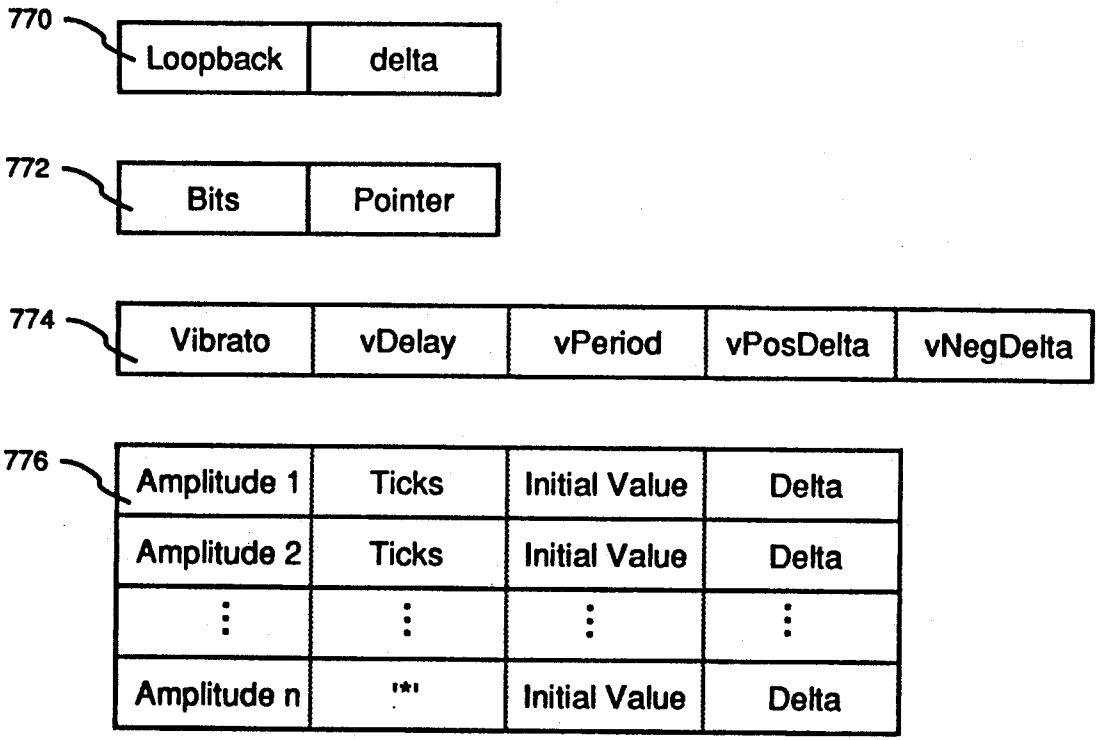
FIGS. 18(*a*) and (*b*) illustrate the code formats in the instrument of the present invention.

Referring now to FIGS. 5(*a*) and (*b*), there is shown the envelope routine of FIG. 3 and a sample waveform, as illustrated in FIG. 18(*c*). The envelope of the waveform is shown as a piece-wise linear graph in the chart of FIG. 5(*b*). The amplitude can vary from 0 to 255, and the time scale is in "ticks." Each tick is 1/45th of a second in one embodiment of the invention. Since the amplitude is serviced every tick, a slope delta is kept for each segment. For example, the first segment varies from 0 to 255 in 10 ticks so at each tick the amplitude changes by 25.5. The piece-wise curve is stored as shown in the Table of FIG. 5(*c*) as the number of ticks for the duration, the slope of that segment, and an initial value. The amplitude values range from 0=silence to 255=maximum volume. Specifically, a local counter counts ticks 189 as the unit of measure to accumulate how much time has occurred as the segments are traversed. The loop 191 progresses for each segment of the piece-wise curve for this track. There is no termination of this loop because there is an "infinite" segment at the end of each envelope, as detailed in the next step. If the ticks value for a segment is a special value (*), then the segment is infinite and never terminates. If so, the routine skips down to the zero test in step 205.

Step 195 determines the ticks accumulated so far in the segment. These ticks for a segment are added to the accumulator 197 before proceeding to the next segment via step 191. For the segment at hand, if this is the first time through 199, then the amplitude of this track is set to the initial value 201. If not, the amplitude is incremented by the slope of this segment 203. If the amplitude of the track goes to zero 205, then the track is turned into a rest by setting the delta to zero 207. This effectively turns off the track until the duration of this note is played out.

Referring now to the flowchart of FIG. 6, the vibrato routine 93 of FIG. 3 is similar to envelope routine 91 except that vibrato varies the pitch of the track as a function of time. It is a much simpler function so the piece-wise technique is not needed. The function is always a triangle wave of pitch vs. time with an optional delay before it modulates the pitch of the wave, as illustrated in the graph of FIG. 18(*c*). Therefore, a vibrato is stored as several values including a delay value during which the pitch is unchanged, and the period of a segment, and then a positive and negative slope. After the delay times out, the negative and positive slopes are alternately used for each period. Specifically, if the note_counter 209, which accumulates elapsed time since a note was started on this track, is within the delay period, then nothing is done and the routine returns to the routine of FIG. 3. At step 211, the interval within a period is calculated, and if the interval is less than half the period 213, the positive slope is used 215. Otherwise the negative slope is used 217.

Referring now to FIG. 7, the flowchart illustrates the bend track routine 95 of FIG. 3 which is similar to the vibrato routine, except that the bend track is controlled by the instrument operator and the pitch is varied much more slowly. It simulates the bender bar 30 of a real guitar (which raises and lowers the pitch by raising or lowering the tension on the string), except that at the limits of the bender bar, the pitch delta is guaranteed to be 2 half steps. Only the tracks playing fret riffs are allowed to be so bent. A track playing a riff will be recorded in the array string_playing and these are the only tracks allowed to be bent as later described herein with reference to FIG. 10(*a*). Specifically, at step 219 the determination of whether the track should be bent is made by determining if any one of the string_playing is set to this track. If the track is not to be 'bent' 219, then return from the routine. Otherwise, the pitch of the note currently playing on this track is determined 221 by backing up from track_ptr (which points to the next opcode after the note). Since note opcodes are two bytes long, the backup is to the pitch byte in order to isolate the pitch number. The magnitude or value of the bender is obtained from the bender bar 30, previously described herein, and is assigned a temporary variable bend 223. The values returned from the bender bar 30 are from −N to +N, where zero means no bending. If the current value of the bender is less than the previous one 225, then the old_bend is decremented 227 so that it approaches the current value. Then, the Bend_Lookup table of FIG. 14(*b*) is referenced 229 as indexed by the pitch determined in step 221. The table contains deltas to the pitch deltas described in step 185. The wave_increment is adjusted 229 to lower the pitch. For example, if old_bend was zero and the current bend is −7, these steps would be executed 7 times to add the Bend_Lookup value 7 times to the wave_increment. This would realize the Delta-Lookup value for a note two half steps lower than the original note, as later described herein with reference to the table Bend_Lookup in FIG. 14(*b*). If the current bender value is greater than the current one 231, the pitch should be raised by incrementing the previous value of old_bend 233 so that it approaches the current value, in the manner as previously described with reference to steps 225–229, except that addition and incrementing replace subtraction and decrementing.

Figure 8A:
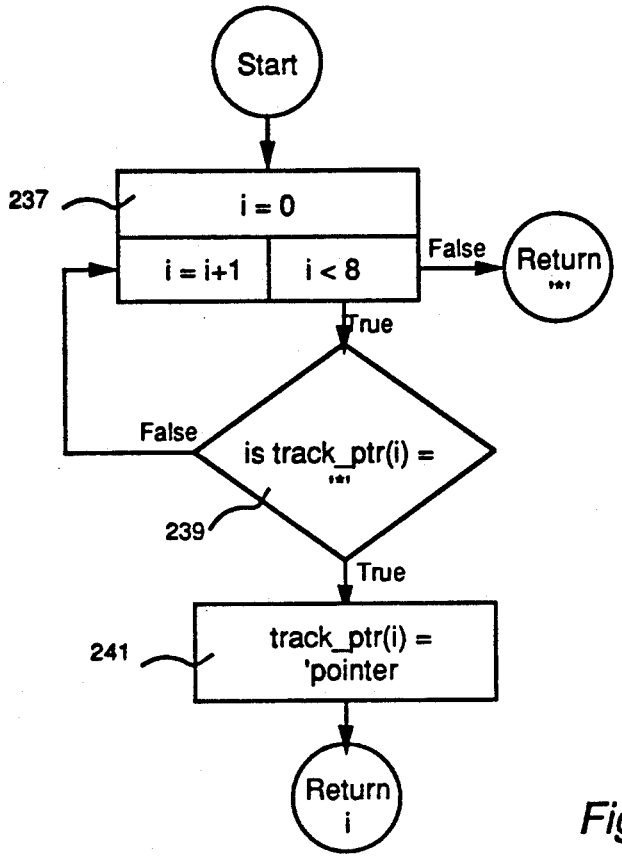
FIGS. 8(*a*) and (*b*) are flow charts illustrating the routine for fetching bytes of information from a selected track of operation codes.
Figure 8B:
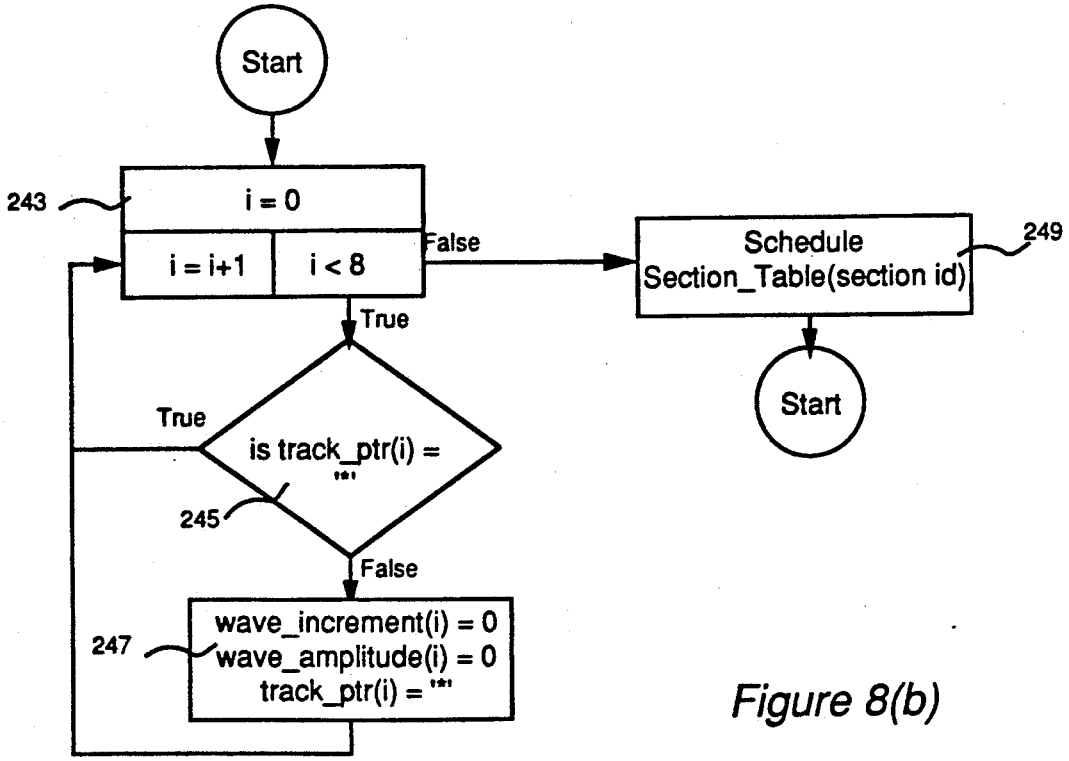

Referring now to FIG. 8(*a*), there is shown the scheduler which takes the passed pointer (which points to an opcode stream), finds a free track and sets the track_ptr to the passed pointer. Specifically, the tracks are iteratively sampled 237, 239 until a free one is found. If none is found, return from the routine. A track is free if its value is designated "*", 239. The free track is assigned the passed pointer 241, to be interpreted during operation of the routine previously described with reference to FIG. 4(*c*).

Referring now to FIG. 8(*b*), the start routine receives the section identification number to play. Any tracks currently playing must first be silenced, and the section is then scheduled to be played, which usually immediately schedules additional tracks. Specifically, each track is examined iteratively 243, and the free tracks (designated with the value "*") are skipped 245. For tracks that are not free or are occupied, the increment and amplitude values for each such track is set to zero and the track_ptr is freed 247. Then, the schedule routine (previously described with reference to FIG. 8(*a*) and step 237) is called 249, with the pointer obtained from the Section_Table (as illustrated and described with reference to FIG. 16) that is indexed by the passed section identification number.

Referring now to FIG. 9, the flowchart illustrates the sound generation process. This is an asynchronous process that runs at the sample rate of digital-to-analog conversion. This routine is invoked every sample interval to produce a new composite sample that is sent to a Digital-to-Analog Connector (DAC) 20. Each sample also has an amplitude value which is used to scale the relative amplitude or contribution of the given track to the composite sound. Specifically, an accumulator used to collect the output samples is initialized to zero 251. Eight tracks are iteratively examined 253–269, and after all tracks have been accumulated, the result is supplied 255 to a Digital-to-Analog Converter 20. The wave_increment is added to the wave_ptr for a given track 261. The pointer is a fixed point number (an 18-bits integer and a 14-bits fraction). One integer corresponds to a byte in memory. So, if the waveform in memory was digitized at middle C, and C below middle C is desired for playback, the increment would be 0.5. The 0.5 is derived from the fact that the playback shall be twice as slow. Assuming the waveform starts at address 1000, the series of addresses calculated in step 261 are: 1000.0, 1000.5, 1001.0, 1001.5, 1002.0 .... The values read are at addresses 1000, 1000, 1001, 1001, 1002, 1002 ... (only the integer portion of the wave_ptr is used 263 for memory fetches). The increments used in wave_increment are derived from the Delta_Lookup table listed in FIG. 14(*a*) later described herein. If the sample value is zero 265, then the routine loops back 267 in the digitized waveform. This the wave_ptr to point earlier in the digitized waveform, as illustrated in FIG. 18(*e*). After the pointer is adjusted with the loopback delta, another sample is fetched 263. If the sample was non-zero, it is multiplied by the amplitude 271, and is then added to the accumulator 269.

Figure 10A:
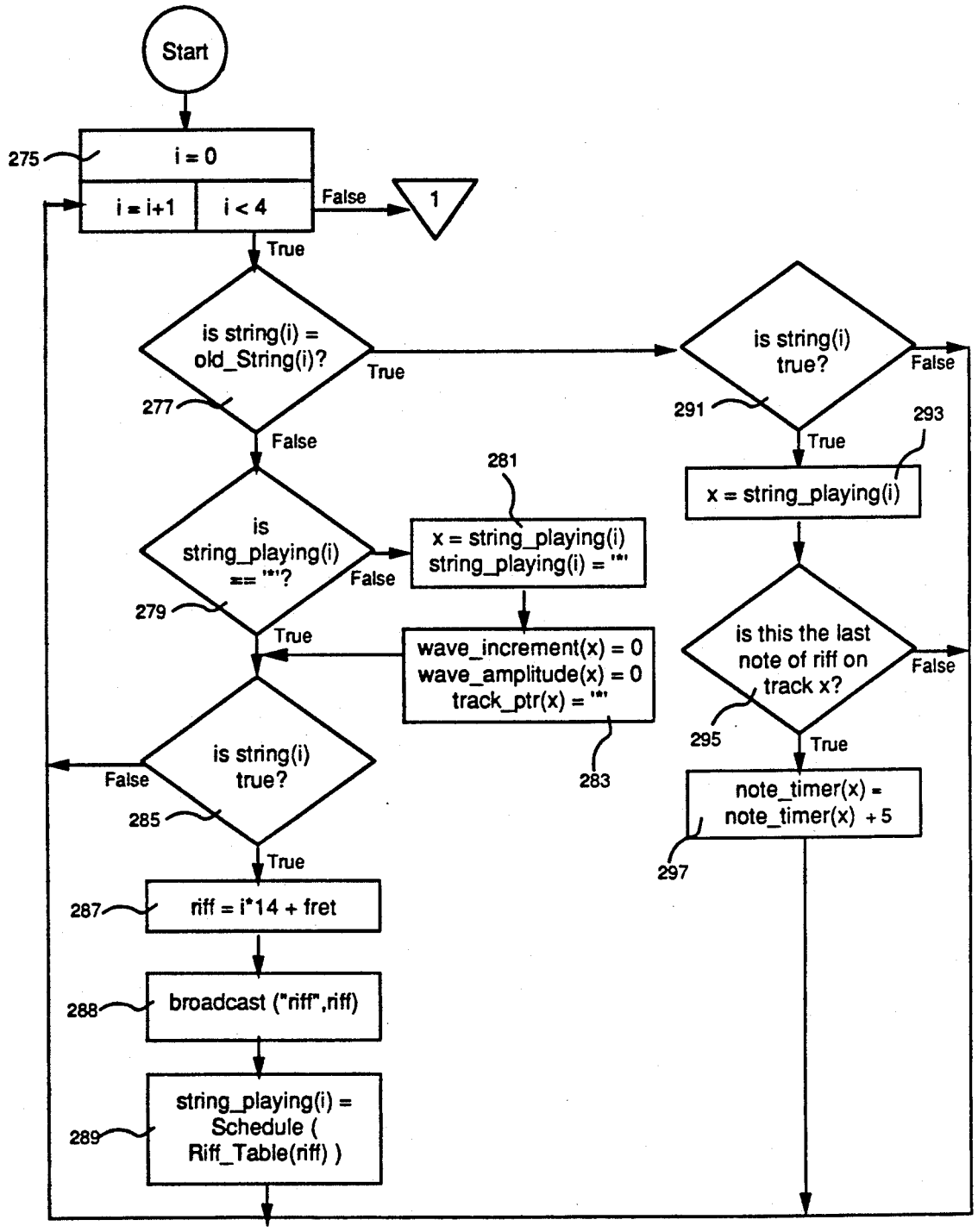
FIGS. 10 (*a*) and (*b*) are flow charts illustrating the routine for decoding fret riffs and fill riffs, respectively.
Figure 10B:
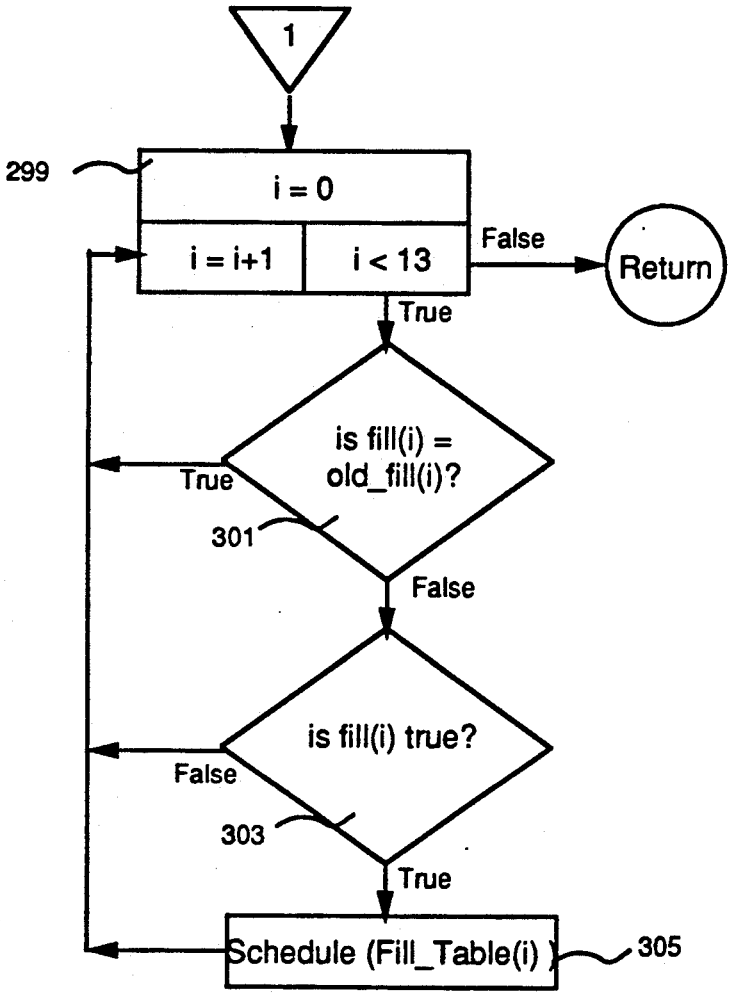

Referring now to FIGS. 10(*a*) and (*b*), there is shown a flowchart of the routine 79 in FIG. 2 which checks for new riffs that have been triggered by the string switches 28 and also checks if any riffs need maintenance. There are three real string switches 28 and one virtual one which is determined from the other three. If all three strings are pressed simultaneously, the fourth virtual string is set and the three real strings are reset. Thus, there are three strings and the virtual fourth string determined from the actual three strings which are iterated 275. At step 277, the current setting of a string switch 28 is checked to determine if it is different from its previous setting saved in old_string. If so, a transition is occurring. If not, the routine skips to step 291. If a given string is currently playing something 279 (the track number is stored in string_playing), then string_playing is reset 281 and the track is silenced 283. If the state of such string switch is going from on to off 285, then the routine continues with the next switch 275. Otherwise, the transition is off to on so a new riff should be played. The riff number is determined from the switch and fret numbers 287. Fret is the number of the current fret switch 32 being held down. The riff number is broadcast 288 to all other similar connected instruments, if any, and the riff to be played is then scheduled 289 using the Riff_Table indexed by the number determined above. The details of the riff table are illustrated and described with reference to FIG. 17. If there is no transition and a string switch 28 is not held down 291, then the routine skips to the next switch. Otherwise, the track number of the riff playing for the string is fetched 293, and if this is not the last note of the riff being played 295, then the routine proceeds to check the next string switch. If the last note of a riff is playing, then the note_timer is incremented 297 by an arbitrary amount to indefinitely sustain the last note in the riff.

With reference to the flowchart of FIG. 10(*b*), this routine checks to determine if any fill riffs have been triggered by the fill switches 29, 31 or combinations of fill switches. As with the string switches, there are virtual switches derived from combinations of the fill switches 29. There are three percussive fill switches 31 and four keyboard-like fill switches 29. Any one or two of the keyboard-like switches 29 is assigned a fill riff. Therefore, there are 13 total fill switches including 7 actual ones and 6 virtual ones. Specifically, then, step 299 increments the routine through all 13 fill-switches and combinations thereof. Step 301 determines if the current setting of a fill switch is different from its previous setting as saved in old_fills. If not different, then the next fill switch is checked 299. If there is a difference, then a transition is occurring, and if the state of such fill switch is going from on to off 303, then the routine continues with the next switch at step 299. Otherwise, a riff is scheduled for playback 305 using the Fill_Table indexed by such fill switch. The details of Fill_Table are illustrated and described with reference to FIG. 17.

Figure 11A:
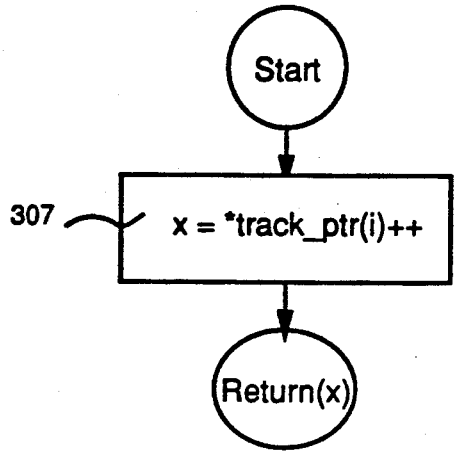
FIGS. 11(*a*) and (*b*) are flow charts illustrating miscellaneous operator routines.
Figure 11B:
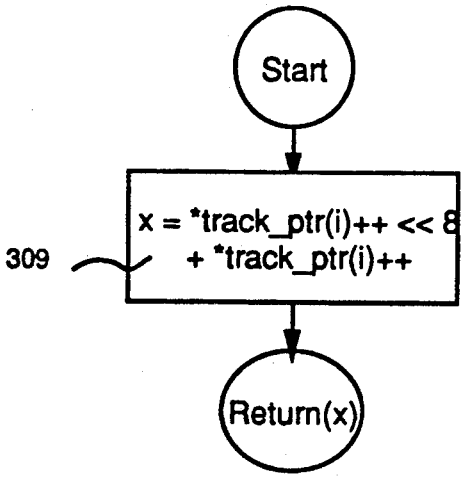

Referring now to FIG. 11(*a*), there is shown a flowchart of the routine which returns one byte at track_ptr and increments the pointer. Specifically, at step 307 a variable 'x' is set and then returned to the byte stored at the specified track_ptr, and the track_ptr is thereafter incremented.

In the flowchart of FIG. 11(*b*), the routine functions similar to the routine of FIG. 11(*a*), except that at step 309 it returns two bytes as a 16-bit number. Thus, a variable 'x' is set and then returned as the two bytes stored at the specified track_ptr, and the track_ptr is thereafter incremented.

Figure 12:
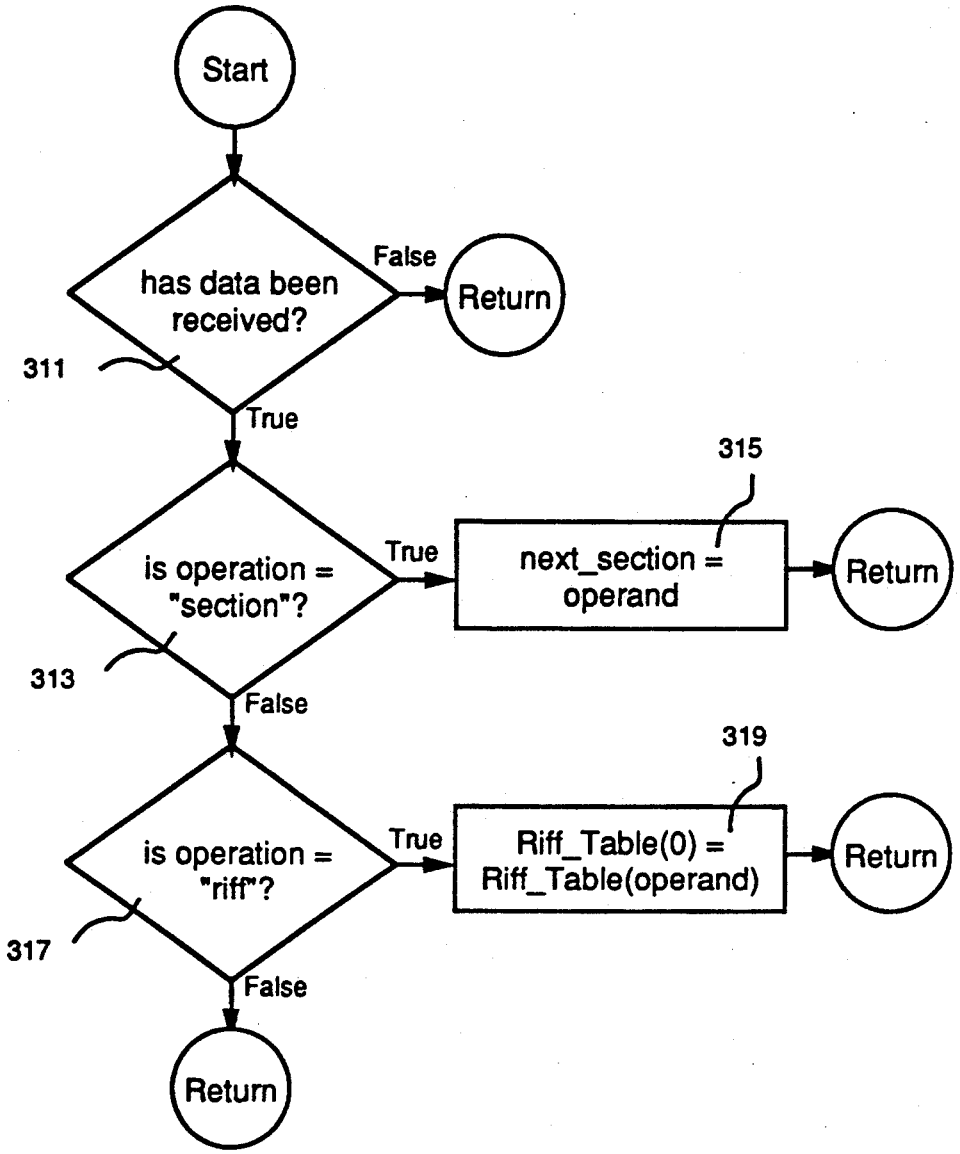
FIG. 12 is a flow chart illustrating the check network routine.

Referring now to the flow chart of FIG. 12, there is shown the routine 80 of FIG. 2 for synchronizing connected instruments of similar design that may have been assembled to play together as a 'band'. The master clocks of such similar instruments are synchronized to assure note to note synchronization. As sections are changed by an operator, the transition is coordinated with all connected instruments. Also, information about each riff played by an operator of a connected instrument is transmitted to the other instruments so the players of the other instruments can mimic the riff being played. This simulates the common technique used by jazz musicians of 'echoing' riffs back and forth during a 'jam session'.

Specifically, step 311 determines if data has been received from another connected instrument. If not, the routine returns to operation as illustrated and described with reference to FIG. 2. If so, two portions of data are received and treated separately. The first portion (i.e., operation data) describes something to be done with the second portion (i.e., operand data). If the operation data is "section number" 313, then the new section to be played is posted 315 from the operand to be played during the main loop, as later described with reference to steps 369–377 of FIG. 13. If the operation is "riff," then the riff address for riff number zero in the Riff_Table is reassinged 319 for use echoed riff, as described at step 289 of FIG. 10(*a*).

Referring now to the tables of FIGS. 14(*a*) and (*b*) (in hexadecimal notation), the Delta Lookup table of FIG. 14(*a*) contains sixteen-bit values which are fixed-point increments for the sound generation. There are 4 integer bits and 12 fraction bits. If, for example, a waveform is a flute playing a middle A and the desired playback is middle A, the singed delta or offset between the recorded pitch and the playback pitch is indexed from the origin. In this case, the number is zero (i.e., no differential since the playback pitch is the same as the recorded pitch), so the increment used is $1000. The fixed point $1000 is equivalent to 1.0, effectively giving a 1:1 playback. If the B above middle A was to be played back, the delta would be $11F6 (index=2) because there are two half steps between the two pitches, which realizes a 1:1.11223996 playback ratio.

The Bent_Lookup table of FIG. 14(*b*) is derived from the Delta_Lookup table. For instance, the origin (i.e., middle C), is derived from the Delta_Lookup table for the same index minus the delta for two lower half steps, divided by 7 (which is the range of the bender in each direction in the illustrated embodiment). Thus: ($1000−$E41)/7=$3F. So if it is desired to bend down from middle C to the A# below middle C, the Bent_Lookup value for middle C would be subtracted 7 times from the wave_increment. This causes the delta to go from the initial $1000 to $E41. As described above, this lowers the pitch by two half steps because the playback ratio is lowered.

Figure 15A:
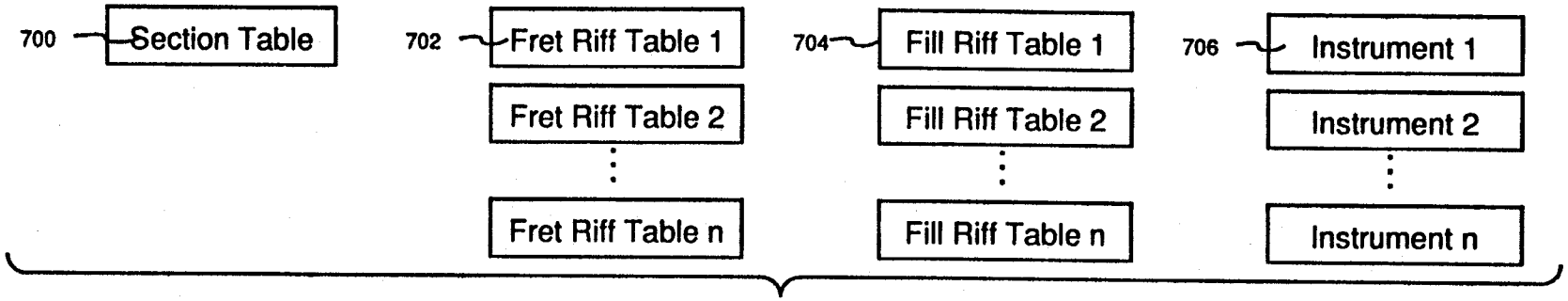
FIGS. 15(*a*) and (*b*) are pictorial illustrations of the ROM structure in the embodiment of FIG. 1(*a*)
Figure 15:
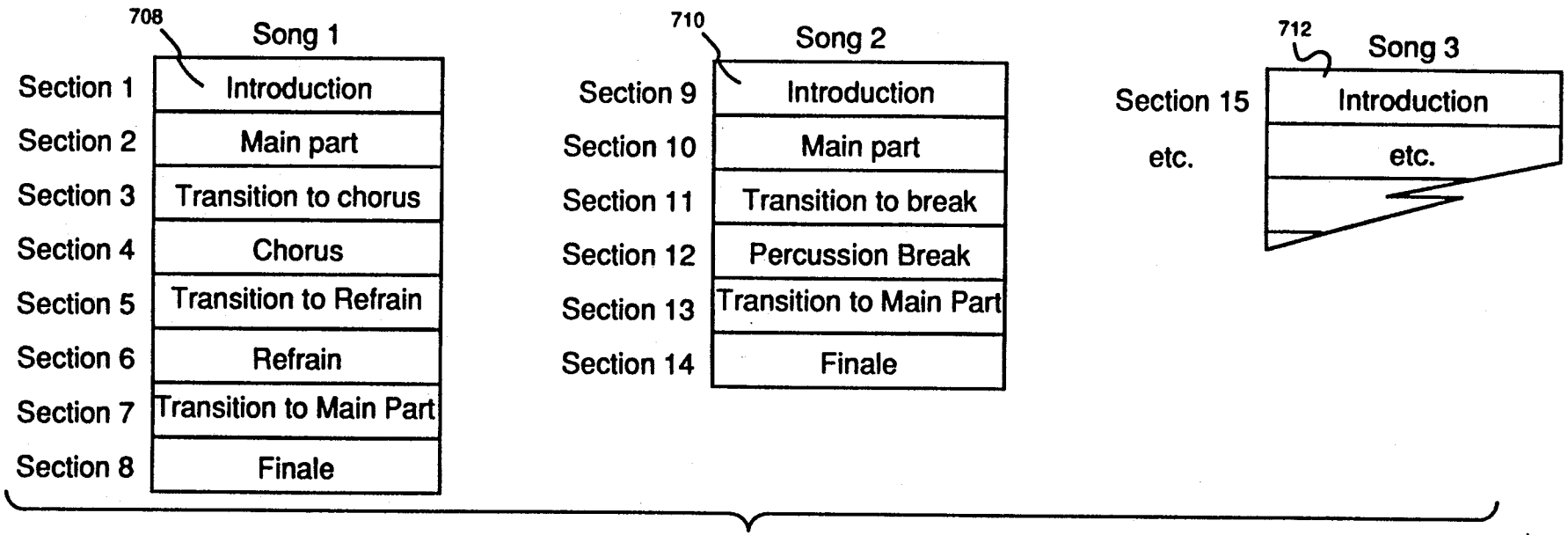

FIG. 15(*a*) illustrates the data structures for the music stored in Read-Only-Memory 19 the embodiment of FIG. 1(*a*). There is a section table 700 which is described with reference to FIG. 16. There is a plurality of Fret Riff table 702 and Fill Riff tables 704 as described with reference to FIG. 17. And there is a plurality of digitized instruments 706 encoded as shown and described with reference to FIG. 18. As illustrated in FIG. 15(*b*), the ROM 19 contains many songs and each song is made up of multiple sections. The ROM 19 may be formed in several sections with at least one section replaceable in convenient matter to contain many other songs. Each song is simply a group of sections 708 (e.g., the first is the introduction; the second section is the main part of the song; the third section is a transition to the chorus which is the fourth section; a transition to a refrain is the fifth, etc.). After some number of sections, the second song 710 begins where the first song left off. Any number of songs are so defined 712. A song is not defined by any special structure but simply comprises multiple sections tied together by the embedded opcodes.

Figure 16:
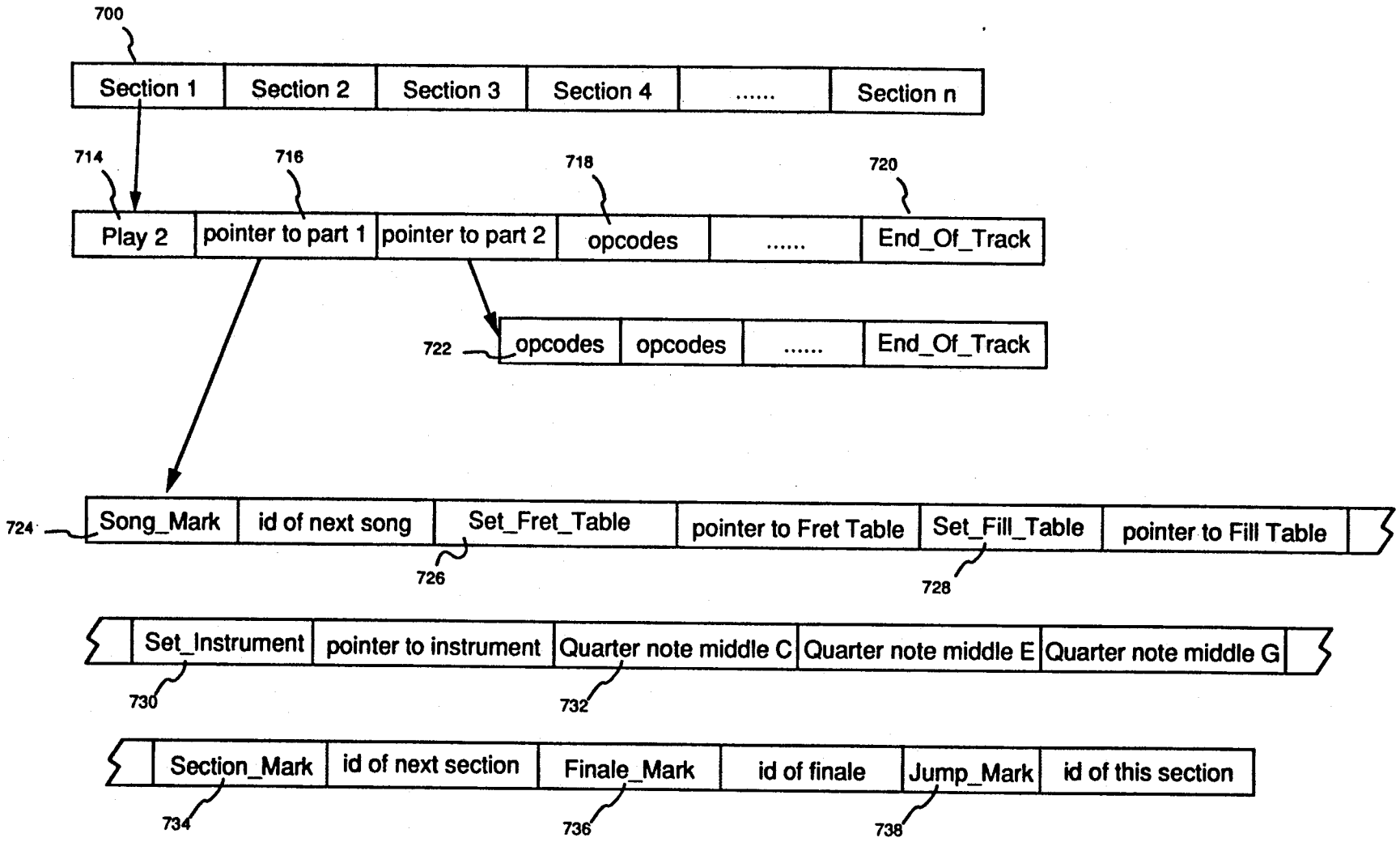
FIG. 16 is an illustration of the section table structure in memory in the embodiment of FIG. 1(*a*)

The section table 700, as illustrated in FIG. 16, is a list of pointers to the opcodes to be interpreted. For example, the opcodes for section 1 are detailed. This section is a simple section that has three parts. The first opcode is a "Play" opcode 714. Since three instrument parts are desired, two additional tracks are scheduled from the pointers stored after the "Play2" opcode 716. After the play opcode and pointers there are additional opcodes 718 (not detailed) which terminate with an "End_Of_Track" opcode 720. The second track scheduled 722 (not detailed) also ends as above. The third representative track 724 is detailed below.

The first opcode 724 defines which section is the next song. So, if the song switch 25 in FIG. 1(*b*) is pressed, the section which begins the next song is identified by this opcode. That identification number is stored following the opcode itself. The next opcode 726 specifies which Fret Riff Table should be used at this point in the song. The pointer that follows points to a fret table as detailed in FIG. 17. The Set_Fill_Table 728 opcode performs the same task for the current Fill Riff Table. This track's current instrument is specified by the Set_Instrument opcode 730 and its associated following pointer. The note opcodes 732 that follow will use this instrument to produce the sound, and one is detailed in FIG. 17(*b*). After the note opcodes there are the Section_Mark 734 and Finale_Mark 736 opcodes. These codes will start a new section (as specified after the opcode) if their respective switches were pressed. Their position in the opcode stream define the jump points according to the music. In practice, each section has many jump points each to different transition sections. The last opcode 738 is an unconditional jump to this section which simply loops back and repeats these opcodes. In this example, the section continuously plays a three note melody, but normally, many measures of music are specified.

Referring now to FIG. 17(*a*), the illustrated riff tables for both the frets and fills are identical except for the number of pointers stored in the table. For example, there may be 52 fret riffs and 10 fill riffs in an embodiment of the present invention. In either case, the table contains pointers to opcode streams 750, exactly like the section table. This stream is scheduled and then interpreted. Only one riff 752 is detailed below as exemplary. The first opcode sets the instrument for this track. Then the notes begin 754. A Repeat opcode 756 follows which loops back to the first opcode if the original string switch is still pressed. If the string switch is up, the routine proceeds to the last note 758 which is held as long as the original fret switch is still pressed, eventually concluding with and End_Of_Track opcode.

Referring now to FIG. 17(*b*), the structure of a note opcode is detailed. The uppermost bit of the first byte 760 is the tied bit. If set, this indicates that the note should not be reattacked when it is started 179 (FIG. 4(*d*)). The lower bits of the first byte 762 are the pitch number. This is used to index into the Delta_Lookup table as shown in FIG. 14(*a*). The second byte is the duration of this note in ticks. The note_timer is set to this value, as shown in FIG. 4(*d*), step 171.

FIGS. 18(*a*)-(*e*) detail the instrument structure, for example, as pointed to by the Set_Instrument opcode. The loopback delta 770 is a singed value added to the wave pointer by the sound generation code if a loopback is detected, as previously described with reference to step 257 in FIG. 9. The bits pointer 772 points to the digitized waveform in memory, and the vibrato parameters 774 are specified to be used as described with reference to FIG. 6. Also, the segments for the envelope 776 are described with reference to FIG. 5(*a*). It should be noted that the waveform can be pointed to by many instrument structures which means that one waveform can be used with different envelopes, vibratos, etc. For instance, one common use is to have, say, a piano instrument structure and a quiet piano instrument structure. They both share the same waveform (so they'll have the same pointer stored in the bits field), but their envelopes of the type illustrated in FIG. 18(*c*) will be different. As another example, a siren-like sound can be created with a plain flute waveform, but with a heavy vibrato of the type illustrated in FIG. 18(*d*).

FIG. 18(*e*) shows a sample waveform of a simple sine wave. The analog form 800 is shown with the corresponding digital samples 798 which are stored, for example, starting at memory location 200. In this embodiment the waveform is digitized with 8-bit values so the range is from 1 to 255. The value 0 is used to indicate loopback, as shown in memory location 224. During playback, the sample should loopback to address 200 once location 224 is reached. In the sample header (FIG. 18b), the loopback delta is "−24" and the bits pointer 792 is "200", which are derived above. The vibrato values 794 are illustrated in FIG. 18(*d*) that yields a curve of frequency modulation in the form of this triangle wave. There is a "20" tick delay before the triangle wave begins. The full period is ten ticks so the value stored is "10." Then the two slopes are given as ±0.125. These will alternately raise and lower the pitch every 5 ticks. The envelope values 796 are graphically displayed in FIG. 18(*c*) for the same values as are listed and illustrated in FIGS. 5(*b*) and (*c*).

Figure 19A:
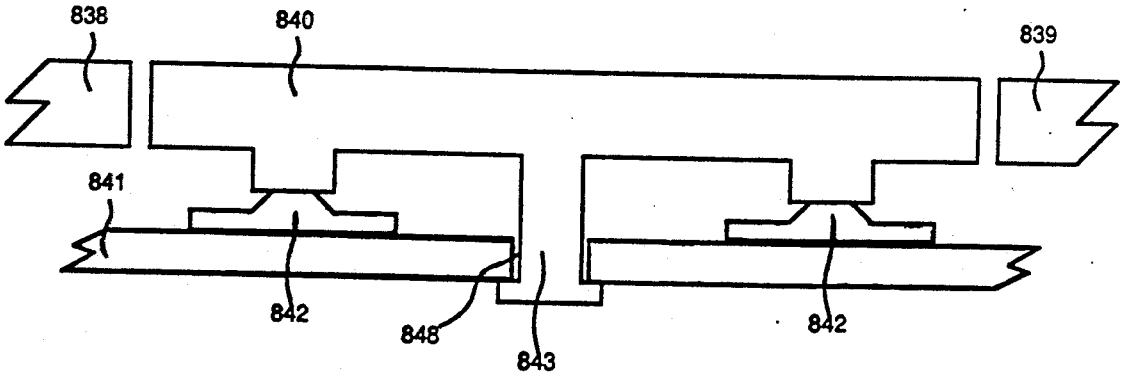
FIGS. 19(*a*)–(*c*) are partial sectional views of frets switches in various operating positions.
Figure 19B:
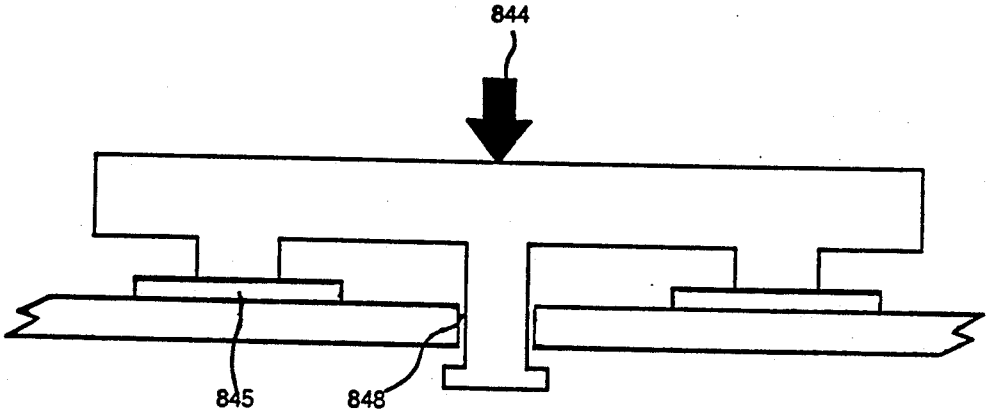
Figure 19C:
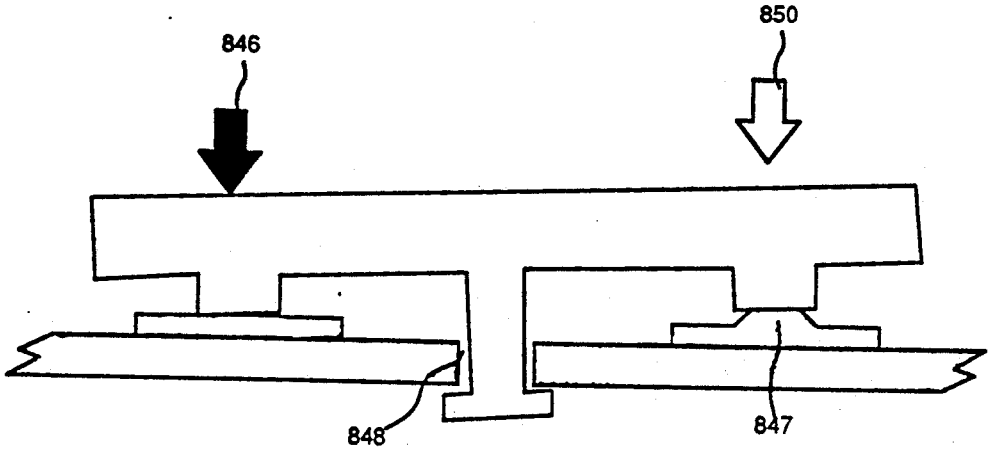
Figure 20:
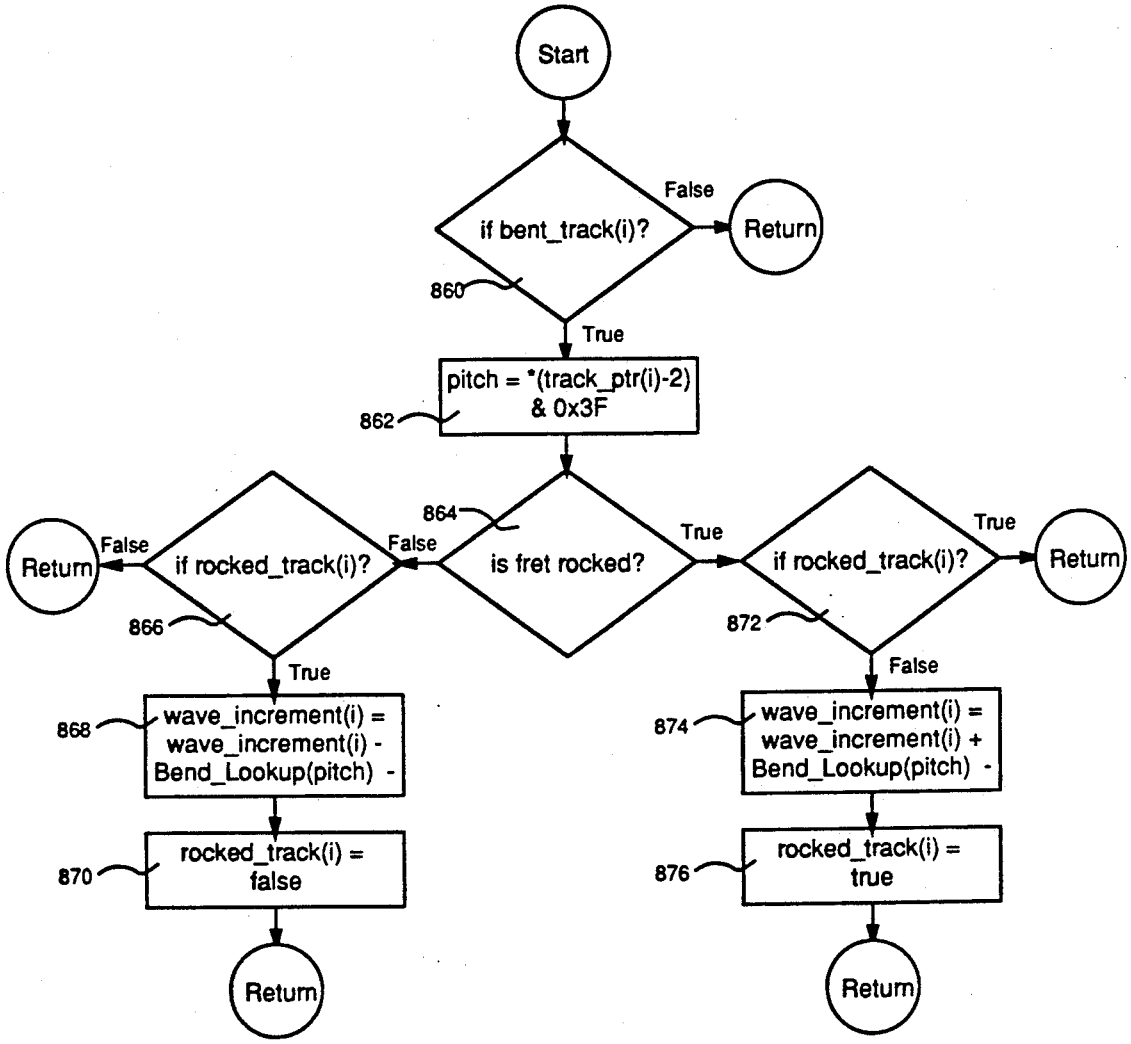
FIG. 20 is a flow chart illustrating the routine for raising and lowering pitch in response to selected actuations of the fret and switches.

Referring now to FIGS. 19(*a*)-(*c*), there are shown partial sectional views of fret switches 32 in various operating positions. These fret switches simulate the vibrato effect that can be achieved on a real guitar by wiggling the finger that holds down a string against the fret board. There are 12 such fret switches 32 on the instrument arranged with one or more adjacent switches 838, 839, 840 along the neck of the instrument. The outer portion of the switch may be formed as a plastic key that covers and is held captive on a backing circuit board 841 via the post 843 disposed within hold 848 in the circuit board. There are two conductive-rubber, dome-type switches 842 of conventional design disposed on the circuit board 841 beneath each key to provide an operator-selected switch function as well as the resilient restoring force and tactile 'feel' of the switch. Normal force 844 supplied by the operator in the central region of a key 840 closes 845 both switches 842, as illustrated in FIG. 19(*b*). Force supplied 846 near one edge of the key 840 closes 845 only one switch and leaves the other switch 842 open 847, as illustrated in FIG. 19(*c*). Closure of either switch 842 in response to normal force 844 is interpreted as a fret switch for purposes of determining which riff to play, as previously described with reference to FIG. 10(*a*), steps 287-289. However, a force 846 asymmetrically applied to a key 840 which closes 845 only one switch and leave the other switch open 847 is initially interpreted as a normal fret-switch closure, as above. However, if the operator then applies force 850 to close the other switch 847 while a note is playing (as by wiggling the finger on the key), then the pitch of the note will vary slightly in response to the routine illustrated and described later herein with reference to FIG. 20 to mimic the vibrato effect on a real guitar.

The fret switches described in FIG. 19 modify the pitch of a note like the bender 30 does via the routine previously described with reference to FIG. 7. If the operator presses the fret switch so that only one of the switches is depressed and then presses the key so that the other switch is pressed, this action is called fret rocking. Specifically, with reference to the flowchart of FIG. 20, step 860 decides whether this track is able to be "bent." If not, return. If so, the current pitch is determined 862 for use as an index in connection with step 221 in FIG. 7. Step 864 determines whether the fret switch is rocked. This means one of the two sides was originally closed (846) and then the other side was later closed. If the fret switch is not currently "rocked", or only one or the two switches is closed, and this track was previously adjusted (i.e., rocked_track was set 866 for this track which means it was altered), then the effects of the adjustment is negated 868 and the track is played as unaltered.

Similarly, if the fret switch is currently "rocked" 864 and this track wasn't previously adjusted 872, then the track's pitch is adjusted up slightly and the track is marked as altered in rocked_track 874.

Figure 21:
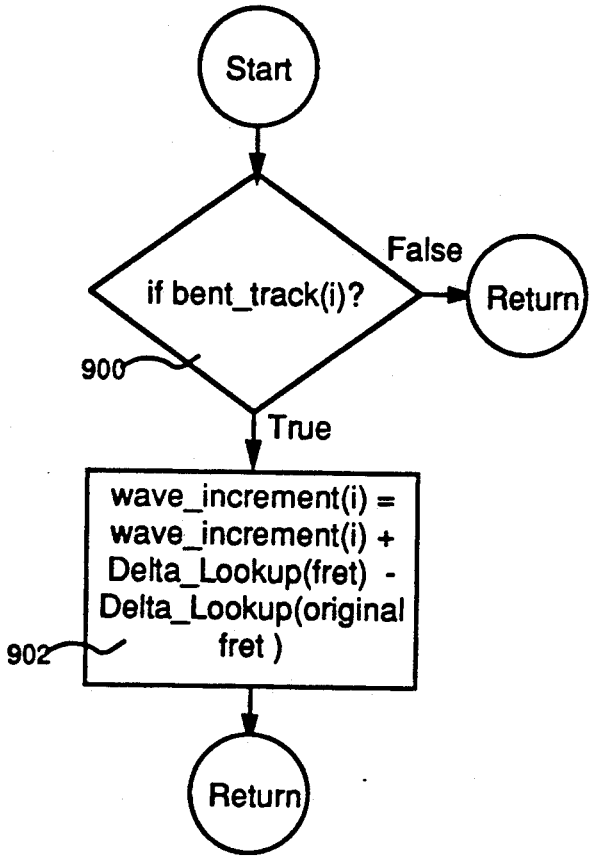
FIG. 21 is a flow chart illustrating the routine for effecting finger slide along the fret switches.

Referring now to FIG. 21, there is shown the flow chart for simulating the common technique used by guitarists to finish a note by quickly sliding a finger up the fret board to alter the string's pitch upwardly before releasing the string (called 'slide bending'). One embodiment of the present invention recognizes that the operator continues to press fret switches while moving the hand up or down the neck and causing neighboring fret switches to be closed. The pitch of a track is altered to simulate the bending effect. Specifically, step 900 determines whether this track is to be bent. If not return. If so, the fret held down to initiate this track is recorded and compared to the current state of the fret switches 902. If there is a difference between these frets, the pitch is altered according to that difference.

Therefore, the electronic musical instrument of the present invention facilitates creative variations of background songs in response to manual controls arranged on an instrument-like device. Also, the instrument of the present invention operates in synchronism with other similar instruments that can be conveniently coupled together to permit operators to simulate playing in a band.

What is claimed is:

1. An electronic musical instrument comprising:

a body;

a first memory means for storing background music sections, each of said background music sections containing one or more operation codes that encode at least one of note pitch, duration and control information;

a second memory means for storing solo music sequences, each of said solo music sequences containing one or more operation codes that encode at least one of note pitch, duration and control information;

a plurality of first switches, each of said first switches being coupled to an associated one of a plurality of first buttons so that the user of said electronic musical instrument can change the electrical state of each of said first switches by operating the associated one of said plurality of first buttons, said first buttons being shaped and distributed on said body in a manner resembling the frets on a guitar;

a plurality of second switches, each of said second switches being coupled to an associated one of a plurality of second buttons so that the user of said electronic musical instrument can change the electrical state of each of said second switches by operating the associated one of said plurality of second buttons, said second buttons being shaped and distributed on said body in a manner resembling the strings on a guitar;

a sound generation means for producing audio signals;

a processing means coupled to said first memory means and to said second memory means and coupled to said sound generation means, said processing means being coupled to said plurality of first switches and to said plurality of second switches, said processing means processing the operation codes in said first memory means and controlling said sound generation means to produce background music, said processing means processing the control information in said first memory means and determining which one of said first switches and which one of said second switches has been operated by the user to select operation codes from said second memory means for a selected one of said solo music sequences, said control information of said background music sections and the one of said first switches which has been operated and the one of said second switches which has been actuated selecting said selected one of said solo music sequences.

2. An electronic musical instrument as in claim 1 wherein said selected one of said solo music sequences is harmonious with said background music and wherein said background music sections comprise at least a first section and a second section and a transition section and further comprising:

a third switch for signalling a transition from said first section to said second section, said third switch being coupled to said processing means, said processing means causing said transition at a musically appropriate point as indicated by the operation codes of said first section in said first memory means, said operation codes including information indicating the musically correct transition point between said first section and said second section.

3. An electronic musical instrument as in claim 2 wherein said transition section is played before said second section and after said processing means causes said transition.

4. An electronic musical instrument as in claim 2 further comprising:

a fourth switch for signalling a transition to a finale section, said finale section being the ending part of said background music, said fourth switch being coupled to said processing means.

5. An electronic musical instrument as in claim 2 wherein said second memory means includes control information indicating which notes in said solo music sequences can be raised or lowered in pitch and wherein said processing means alters the pitch of such notes which can be raised or lowered according to the state of the first switch above the one of said first switches which has been operated and the first switch below the one of said first switches which has been operated.

6. An electronic musical instrument as in claim 1 further comprising:

an encoded switch means being located on said body and being shaped in a manner resembling a bender bar on a guitar, said encoded switch means encoding a plurality of distinguishable radial switch positions, one of said radial switch positions being selected by said user, said encoded switch means being coupled to said processing means to provide the radial switch position selected by said user, said processing means calculating a pitch adjustment for said selected one of said solo music sequences and modifying the pitch of said selected one of said solo music sequences.

7. An electronic musical instrument as in claim 1 wherein said processing means determines whether at least two of said second switches are operated concurrently and controls said sound generation means to produce a plurality of selected solo music sequences if at least two of said second switches are operated concurrently, wherein said plurality of selected solo music sequences resembles a chord of solo music.

8. An electronic instrument as in claim 7 wherein said plurality of second switches comprises 2 to 6 said second switches.

9. An electronic musical instrument as in claim 1 wherein said second memory means includes control information indicating which notes in said solo music sequences can be raised or lowered in pitch and wherein said processing means alters the pitch of such notes which can be raised or lowered according to the state of the first switch above the one of said first switches which has been operated and the first switch below the one of said first switches which has been operated.

10. An electronic musical instrument as in claim 1 wherein each of said first switches comprises a two part switch having a first part switch and a second part switch and wherein said processor modifies the pitch of notes in said selected one of said solo music sequences if, for a particular first switch, said first part switch is actuated and then said second part switch is actuated during playback of said selected one of said solo music sequences.

11. An electronic musical instrument as in claim 1 wherein said processing means repeats a sequence of musical data in response to one of said plurality of second switches being actuated continuously.

12. An electronic musical instrument as in claim 1 wherein said processing means monitors the state of the one of said first switches which has been actuated and sustains selected notes of said selected one of said solo music sequences.

13. An electronic musical instrument as in claim 1 wherein said plurality of second switches comprises 2 to 6 said second switches.

14. A network of electronic musical instruments resembling a band, said network comprising:

a first electronic musical instrument comprising:

a first body;

a first memory means for storing background music sections, each of said background music sections containing one or more operation codes that encode at least one of note pitch, duration and control information and said first memory means for storing solo music sequences, each of said solo music sequences containing one or more operation codes that encode at least one of note pitch, duration and control information;

a plurality of first switches on said first body, each of which is operable by the user of said first electronic musical instrument;

a plurality of second switches on said first body, each of which is operable by the user of said first electronic musical instrument;

a first sound generation means for producing audio signals;

a first processing means coupled to said first memory means and coupled to said first sound generation means, said processing means being coupled to said plurality of first body, said first processing means processing the operation codes in said first memory means and controlling said first sound generation means to produce background music, said first processing means processing the control information of said background music section in said first memory means and determining which one of said first switches on said first body and which one of said second switches on said first body has been operated by the user to select operation codes from said first memory means for a selected one of said solo music sequences, wherein said control information of said background music section in said first memory means and the one of said first switches on said first body which has been operated selects a subset of said solo music sequences in said first memory means and the one of said second switches on said first body which has been operated activates the playback of said selected one of said solo music sequences from said first memory means which is one of the solo music sequences in said subset of said solo music sequences;

a second electronic musical instrument comprising:

a second body;

a second memory means for storing said background music section, each of said background music sections containing one or more operation codes that encode at least one of note pitch, duration and control information and said second memory means for storing said solo music sequences, each of said solo music sequences containing one or more operation codes that encode at least one of note pitch, duration and control information;

a plurality of first switches on said second body, each of which is operable by the user of said second electronic musical instrument;

a plurality of said second switches on said second body, each of which is operable by the user of said second electronic musical instrument;

a second sound generation means for producing audio signals;

a second processing means coupled to said second memory means and coupled to said second sound generation means, said second processing means being coupled to said plurality of first switches on said second body and to said second plurality of second switches on said second body, said second processing means processing the operation codes in said second memory means and controlling said second sound generation means to produce said background music, said second processing means processing the control information of said background music section in said second memory means and determining which one of said first switches on said second body has been operated by the user and which one of said second switches on said second body has been operated by the user;

a signal connection means for connecting said first electronic musical instrument and said second electronic musical instrument;

a means for providing a first data transmission for synchronizing said first processing means and said second processing means to ensure that the same notes in said background music sections are played at the correct time.

15. A network of electronic musical instruments as in claim 14 wherein said selected one of said solo music sequences is harmonious with said background music and wherein said background music sections comprise at least a first section and a second section and a transition section and further comprising:

a third switch on said first body for signalling a transition from said first section to said second section, said third switch being coupled to said first processing means, said first processing means causing said transition at a musically appropriate point as indicated by the operation codes of said first section and said first memory means, said operation codes including information indicating the musically correct transition point between said first section and said second section;

a means for providing a second data transmission for transmitting said signal indicating a transition to said second electronic musical instrument such that the transition to the second section is synchronized between said first electronic musical instrument and said second electronic musical instrument.

16. A network of electronic musical instruments as in claim 15 further comprising:

a means for providing a third data transmission for transmitting an identification of said selected one of said solo musical sequences from said first electronic musical instrument to said second electronic musical instrument causing said second electronic musical instrument to echo said selected one of said solo musical sequences.

17. A network of electronic musical instruments resembling a band as in claim 14, wherein said second processing means selects operation codes from said second memory means for a second selected one of said solo music sequences, wherein said control information of said background music section in said second memory means and the one of said first switches on said second body which has been operated selects a second subset of said solo music sequences in said second memory means and the one of said second switches on said second body which has been operated activates the playback of said second selected one of said solo music sequences from said second memory means which is one of the solo music sequences in said second subset of said solo music sequences, whereby said first and said second electronic musical instruments together play the same background music section while said first and said second electronic musical instrument play different solo music sequences.

18. A network of electronic musical instruments resembling a band as in claim 17 wherein said second selected one of said solo music sequences and said selected one of said solo music sequences are harmonious with said background music.

19. An electronic musical instrument comprising:

a body;

a memory means for storing background music sections, each of said background music sections containing one or more operation codes that encode at least one of note pitch, duration and control information and said memory means for storing solo music sequences, each of said solo music sequences containing one or more operation codes that encode at least one of note pitch, duration and control information;

a plurality of first switches, each of which is operable by the user of said electronic musical instrument;

a plurality of second switches, each of which is operable by the user of said electronic musical instrument;

a sound generation means for producing audio signals;

a processing means coupled to said memory means and coupled to said sound generation means, said processing means being coupled to said plurality of first switches and to said plurality of second switches, said processing means processing the operation codes in said memory means and controlling said sound generation means to produce background music, said processing means processing the control information of said background music section in said memory means and determining which one of said first switches and which one of said second switches has been operated by the user to select operation codes from said memory means for a selected one of said solo music sequences, wherein said control information of said background music section and the one of said first switches which has been operated selects a subset of said solo music sequences and the one of said second switches which has been operated activates the playback of said selected one of said solo music sequences which is one of the solo music sequences in said subset of said solo music sequences.

20. An electrical musical instrument as in claim 19 wherein said selected one of said solo music sequences is harmonious with said background music and wherein said background music sections comprise at least a first section and a second section and a transition section and further comprising:

a third switch for signalling a transition from said first section to said second section, said third switch being coupled to said processing means, said processing means causing said transition at a musically appropriate point as indicated by the operation codes of said first section in said memory means, said operation codes including information indicating the musically correct transition point between said first section and said second section.

21. An electronic musical instrument as in claim 19 wherein said processing means determines whether at least two of said second switches have been operated within a small interval of time or very rapidly in sequence and wherein said processing means initiates the playback of an alternate solo sequence which is not part of said subset of solo music sequences.

22. A method for electronically producing music signals for the generation of musical sounds, the method comprising:

storing a background musical data containing at least two sequences of background data from one song;

storing a first and a second predetermined solo musical data each of which is musically related to one of said two sequences of background data from said one song and each of which contains a sequence of at least two subparts of solo musical data;

generating musical sounds from said background musical data and from a selected one of said first and said second solo musical data in response to the actuation of said first and said second switch, wherein said selected one of said first and said second solo musical data is determined by which of said two sequences of background musical data is being used to generate the musical sounds, and wherein said two sequences of background musical data may be dynamically and alternatively selected thereby causing dynamic selection between said first and said second solo musical data and wherein said first switch selects a particular subpart of solo musical data and said second switch when actuated causes the playing of said selected solo musical data.

23. A method as in claim 22 wherein said first and said second solo musical data is related to said two sequences of background data such that said first solo musical data is harmonious with the first of said two sequences of background data and said second solo musical data is harmonious with the second of said two sequences of background data and wherein said background musical data and said first and said second solo musical data are stored in digital form.

24. A method as in claim 23 further comprising the steps of:

providing control operation codes in said first and in said second solo musical data, said control operation codes in said first solo musical data indicating which notes in said first solo musical data can be sustained in duration, and said control operation codes in said second solo musical indicating which notes in said second solo musical data can be sustained in duration;

monitoring the state of the first switch and sustaining selected notes of said selected one of said first and said second solo musical data as long as said first switch remains actuated.

* * * * *